US008699745B2

(12) United States Patent
Saiki

(10) Patent No.: US 8,699,745 B2
(45) Date of Patent: Apr. 15, 2014

(54) SPEAKER, AND MOBILE ELECTRONIC DEVICE

(75) Inventor: Shuji Saiki, Nara (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/997,986

(22) PCT Filed: Mar. 15, 2010

(86) PCT No.: PCT/JP2010/001825

§ 371 (c)(1),
(2), (4) Date: Dec. 14, 2010

(87) PCT Pub. No.: WO2010/131404

PCT Pub. Date: Nov. 18, 2010

(65) Prior Publication Data

US 2012/0106774 A1 May 3, 2012

(30) Foreign Application Priority Data

May 12, 2009 (JP) ..... 2009-115395

(51) Int. Cl.
*H04R 1/00* (2006.01)

(52) U.S. Cl.
USPC ..... 381/412; 381/423; 381/415

(58) Field of Classification Search
USPC ..... 381/396, 420, 412, 413, 415
See application file for complete search history.

(56) References Cited

U.S. PATENT DOCUMENTS

| | | | | |
|---|---|---|---|---|
| 6,208,237 | B1 | 3/2001 | Saiki et al. | |
| 6,570,993 | B1 * | 5/2003 | Fukuyama | 381/396 |
| 6,724,908 | B2 * | 4/2004 | Fukuyama | 381/396 |
| 2003/0015942 | A1 * | 1/2003 | Takeshima et al. | 310/348 |
| 2007/0140521 | A1 * | 6/2007 | Mitobe et al. | 381/420 |
| 2007/0189577 | A1 * | 8/2007 | Tsuda et al. | 381/415 |
| 2007/0200468 | A1 * | 8/2007 | Heim | 310/800 |

FOREIGN PATENT DOCUMENTS

| | | |
|---|---|---|
| JP | 55-55696 | 4/1980 |
| JP | 56-58398 | 5/1981 |
| JP | 58-137400 | 8/1983 |
| JP | 9-312895 | 12/1997 |
| JP | 11-68903 | 3/1999 |
| JP | 2004-274206 | 9/2004 |
| JP | 2007-221787 | 8/2007 |
| JP | 2009-27682 | 2/2009 |
| WO | 2006/087866 | 8/2006 |

OTHER PUBLICATIONS

Extended European Search Report issued Sep. 3, 2012 in corresponding European Application No. 10774665.3.

* cited by examiner

*Primary Examiner* — Duc Nguyen
*Assistant Examiner* — Phan Le
(74) *Attorney, Agent, or Firm* — Wenderoth, Lind & Ponack, L.L.P.

(57) ABSTRACT

A speaker and the like, which is capable of wideband reproduction by improving the bass characteristic, and which is suitable for size reduction, is provided.

A housing (110) includes one main surface (111) having a polygonal shape, and an opening portion (112) in the one main surface. A diaphragm (120) is disposed in the opening portion so as to cover the one main surface, except for corner regions (115*a*, 115*b*, 115*c*, and 115*d*) which are areas in the vicinity of respective vertices of a polygonal shape of the one main surface. A driving unit (130) causes the diaphragm to vibrate so as to generate a sound corresponding to a signal inputted from an outside. A plurality of movable supports (140*a*, 140*b*, 140*c*, and 140*d*) is disposed in the respective corner regions, for supporting the diaphragm by joining the housing and the diaphragm such that the diaphragm is vibratable.

5 Claims, 20 Drawing Sheets

SPEAKER, AND MOBILE ELECTRONIC DEVICE

TECHNICAL FIELD

The present invention relates to a small scale speaker, and more particularly, to technology for improving the bass characteristic of a micro speaker which is known as a receiver.

BACKGROUND ART

As recent mobile phones have continuously been reduced in size and thickness, it has become difficult to ensure enough space for disposing a speaker inside the mobile phone. On the other hand, the size of hearing aids needs to be small because the hearing aids need to be worn inside the external acoustic meatus and there is a high demand for visually unobtrusive hearing aids.

Therefore, it is desired to reduce the size of speakers for use in mobile electronic devices such as mobile phones and hearing aids.

Speakers of mobile phones include: receivers which reproduce received voices, external sounds, and the like; and micro speakers which reproduce ringtones, music signals, and the like. On the other hand, speakers included in hearing aids function simply as the receivers.

The receivers included in the mobile phones and the hearing aids need to reproduce the received voice, the external sound, and the like, and therefore it is necessary to reproduce voices so that vowels and consonants are distinctly identifiable. Thus, as compared to the micro speakers and the like, which are used to reproduce the ringtones, the music signals, and the like, the receivers are required to have excellent bass characteristic and be capable of wideband reproduction.

On the other hand, if a typical speaker, which includes an edge for supporting the outer circumferential part of a diaphragm, is reduced in size, the width of the edge is narrowed and the stiffness of the edge is increased, thereby degrading the bass characteristic.

As described above, the receivers included in the mobile phones and the hearing aids are required to satisfy the improvement in bass characteristic simultaneously with its size reduction, which are requirements conflicting with each other.

Patent Literature 1 discloses a conventional speaker that is different from the typical speaker described above and does not include the edge for supporting the outer circumferential part of the diaphragm. FIG. 23A is a front view of the conventional speaker disclosed in Patent Literature 1. FIG. 23B is a sectional view of the conventional speaker.

In FIG. 23A and FIG. 23B, reference numeral 1 designates a yoke, reference numeral 2 designates a center pole, reference numeral 3 designates a through-hole, reference numeral 4 designates a magnet, reference numeral 5 designates a yoke, reference numeral 6 designates a frame, reference numeral 9 designates a diaphragm, reference numeral 10 designates a coil bobbin, reference numeral 11 designates a voice coil, reference numeral 12 designates a coupling cone, reference numeral 13 designates a magnetic fluid, reference numeral 14 designates wires, reference numeral 15 designates an electric heating liquid, reference numeral 17 designates a closed container, reference numeral 19 designates a sound-absorbing material, and reference numeral 21 designates fixing bolts.

Patent Literature 1 discloses that "in an embodiment as shown, the coil bobbin 10 and each wire 14 are joined to each other in the middle between the sealing magnetic gap and a voice coil driving magnetic gap, and each wire 14 is wound one or more times around the coil bobbin 10. Additionally, each wire 14 is disposed in each of the four through-holes 20 provided in the yoke 5 in the radial direction. The tension of the wires 14 is adjusted by the fixing bolts 21. This fixing bolt 21 also prevents leakage of the electric heating liquid 15, and thus the electric heating liquid can be injected by loosening up the 21."

As described above, the speaker disclosed in Patent Literature 1 uses the wires 14, instead of the annular-shaped edge, to support the diaphragm 9 so that the diaphragm 9 is vibratable. Patent Literature 1 also discloses that "the annular-shaped edge member is not required, and thus the bass distortion is reduced even with respect to large amplitude."

Patent Literature 1 further discloses that the center of the coil bobbin 10 is held by the magnetic fluid 13, and the heat of the voice coil 11 is released through the magnetic fluid 13.

CITATION LIST

Patent Literature

Patent Literature 1: Japanese Laid-Open Patent Publication No. 56-58398

SUMMARY OF THE INVENTION

Problems to be Solved by the Invention

However, in the conventional speaker, the end portion of the wire is hardly movable. Because of this, unless the wires that support the diaphragm are extended longer than the outer circumference of the diaphragm, a range in which the diaphragm is movable is significantly restricted, eliminating an allowance for each wire to be extended, so that it becomes difficult to achieve the large amplitude required for the bass reproduction. Thus, shortening the length of the wires for the sake of the size reduction restricts the movements of the wires, and suppresses the bass reproduction. Therefore, it is difficult to realize a receiver which is reduced in size and small enough to be used in the hearing aids and the like, and which has high quality sounds, achieving both the size reduction and the bass reproduction.

Hence, an object of the present invention is to provide a speaker, which is capable of the wideband reproduction by improving the bass characteristic, and which is suitable for size reduction, and a mobile electronic device having the speaker mounted therein.

Solution to the Problems

The present invention is directed to a speaker, a hearing aid, and a mobile information processing device. In order to achieve the object, the speaker of the present invention includes a housing, a diaphragm, a driving unit, and a plurality of movable supports.

The housing includes one main surface having a polygonal shape, and an opening portion in the one main surface. The diaphragm is disposed in the opening portion so as to cover the one main surface, except for corner regions which are areas in the vicinity of respective vertices of a polygonal shape of the one main surface. The driving unit causes the diaphragm to vibrate so as to generate a sound corresponding to a signal inputted from an outside. The plurality of movable supports, disposed in the respective corner regions, support the diaphragm by joining the housing and the diaphragm such that the diaphragm is vibratable.

Preferably, each one of the corner regions is located so as to be substantially surrounded by an outer circumference of the diaphragm and a vicinity of a corresponding one of the vertices formed by two sides forming a corresponding one of the vertices of the polygonal shape in the one main surface.

Preferably, the housing is shaped in a substantially rectangular prism, the one main surface has a substantially square shape, or a substantially rectangular shape, and the diaphragm has, when viewed in a front direction in which the one main surface is viewed in plan view, a substantially round shape, a substantially elliptical shape, or a substantially track shape perimeter.

Preferably, the plurality of movable supports each includes an elastic body disposed in a corresponding one of the corner regions so as to have elasticity in directions parallel to one of two sides forming a corresponding one of the vertices of the polygonal shape in the one main surface, and a coupling which couples between the elastic body and the diaphragm, and which vibrates together with the diaphragm.

Preferably, the coupling has a rib formed therein to enhance rigidity.

Preferably, the plurality of movable supports are integrally formed with the diaphragm, and a thickness of the elastic body is less than that of the diaphragm.

Preferably, each of the plurality of movable supports is an elastic body disposed in a corresponding one of the corner regions so as to have elasticity in directions of a bisector of an angle formed by corresponding two sides forming a corresponding one of the vertices of the polygonal shape in the one main surface.

Preferably, the movable supports are integrally formed with the diaphragm, and a thickness of each movable support is less than that of the diaphragm.

Preferably, each of the movable supports has a cross section, perpendicular to the one main surface, including a line in a direction extending between the housing side and the diaphragm side, and a shape of the cross section is substantially an arc shape.

Preferably, the driving unit includes a magnetic circuit disposed in the housing, a magnetic gap provided in the magnetic circuit, a voice coil inserted in the magnetic gap, and a magnetic fluid filled in a gap between the voice coil and the magnetic circuit, the diaphragm is joined at the outer circumferential part thereof to the voice coil, and the magnetic circuit includes at least one sound hole extending therethrough in a direction perpendicular to the one main surface.

Preferably, the driving unit includes a magnetic circuit disposed in the housing, a magnetic gap provided in the magnetic circuit, and a voice coil inserted in the magnetic gap, the diaphragm is joined at the outer circumferential part thereof to the voice coil, the magnetic circuit includes at least one sound hole extending therethrough in a direction perpendicular to the one main surface, and a gap between the voice coil and the magnetic circuit is less than or equal to 50 μm.

The present invention is directed to a mobile electronic device, such as hearing aids and mobile phones, that has mounted therein the speaker described above. In order to achieve the above objective, the mobile electronic device of the present invention has therein the speaker described above.

Advantageous Effects of the Invention

As described above, in the present invention, the diaphragm is disposed on the polygonal-shaped main surface of the housing so as to cover the main surface, except for corner regions. Movable supports, which join the housing and the diaphragm such that the diaphragm is vibratable, are disposed in the respective corner regions to support the diaphragm. Thus, the diaphragm having, for example, a round shape, an elliptical shape, or a track shape perimeter, that is not an angular shape, is disposed on the main surface, of the housing, having the polygonal shape such as a square shape or a rectangular shape, in maximally efficient manner, and, at the same time, movable supports can be enlarged in limited spaces. Accordingly, the speaker can be provided, which is capable of the wideband reproduction by improving the bass characteristic, and which is suitable for size reduction.

Further, the movable supports are integrally formed with the diaphragm, and a thickness of each movable support is less than that of the diaphragm so that each movable support has elasticity. Thus, the number of components is reduced, thereby reducing a manufacturing cost.

Still further, the magnetic fluid is filled in a gap between the voice coil and the magnetic circuit, or the gap is less than or equal to 50 μm so that the sound leakage is blocked, or reduced, and thus, the sound can be efficiently emitted from the speaker.

DESCRIPTION OF EMBODIMENTS

[First Embodiment]

<Overview>

A first embodiment is a speaker in which a substantially disc-shaped diaphragm is disposed on a substantially square-shaped main surface of a housing, and which includes movable supports, instead of the edge of the conventionally used typical speaker, which are provided in the vicinity of respective vertices of the main surface, for joining the housing and the diaphragm such that the diaphragm is vibratable.

<Configuration>

Figure 1:
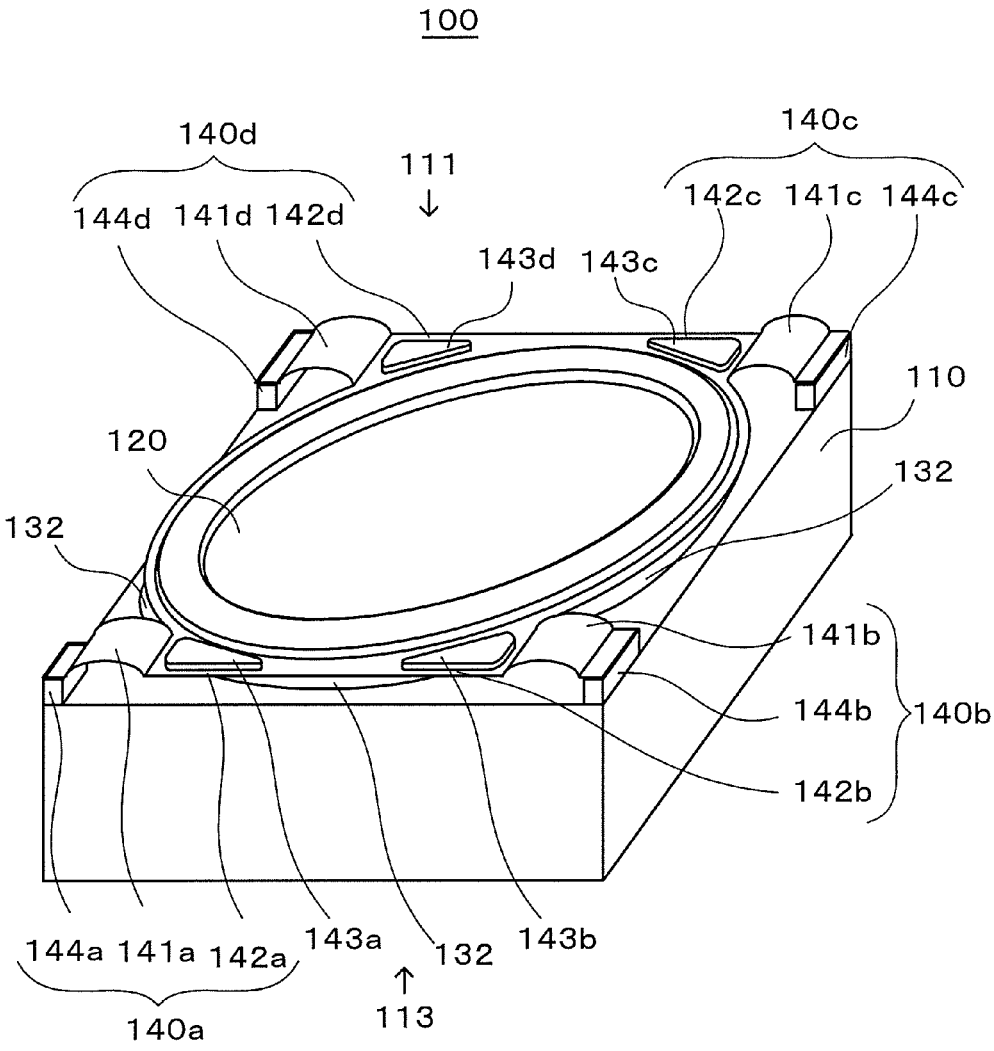
FIG. 1 is an external view of a speaker 100 according to a first embodiment.
Figure 2:
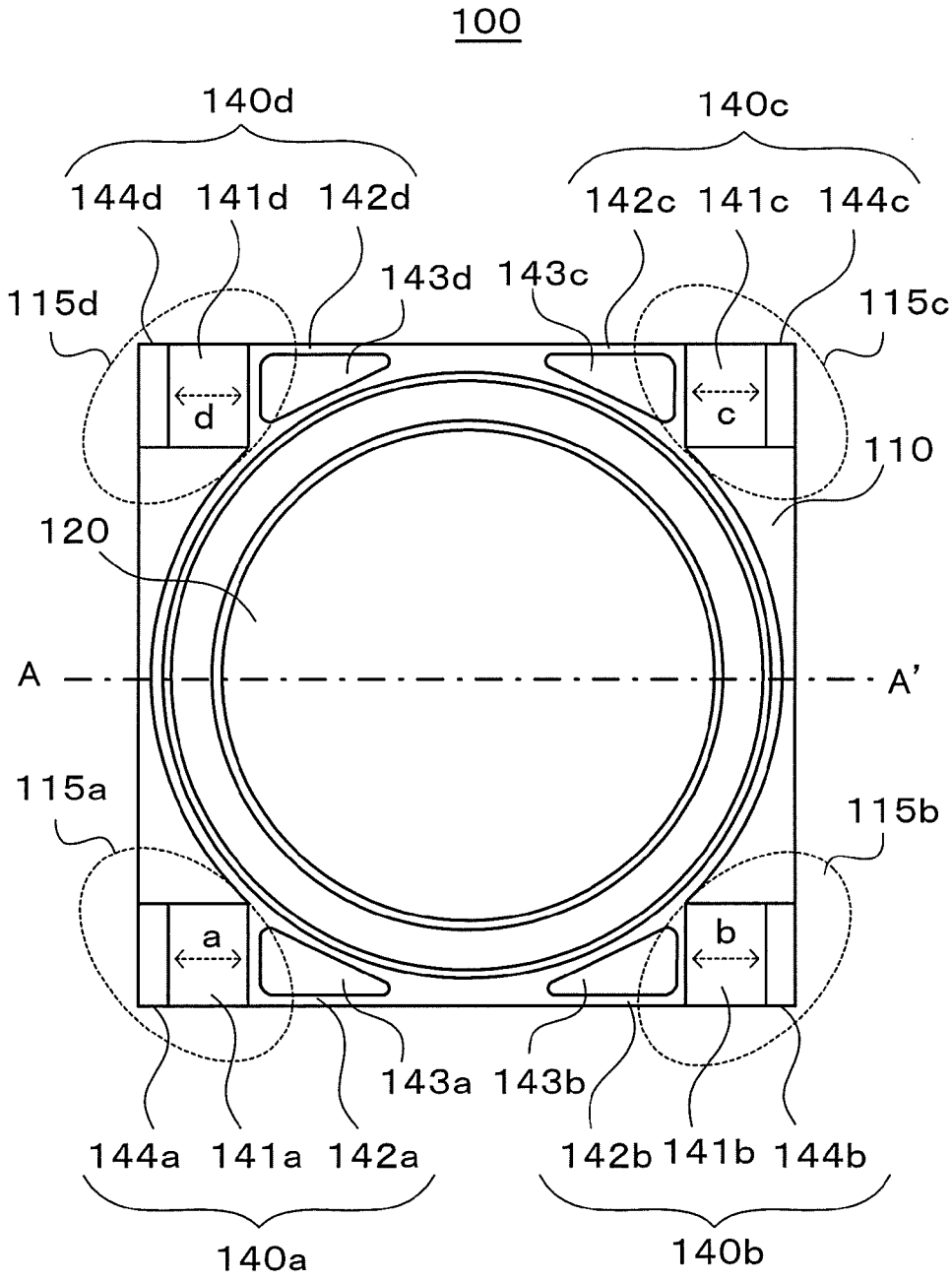
FIG. 2 is a plan view of the speaker 100 according to the first embodiment.
Figure 3:
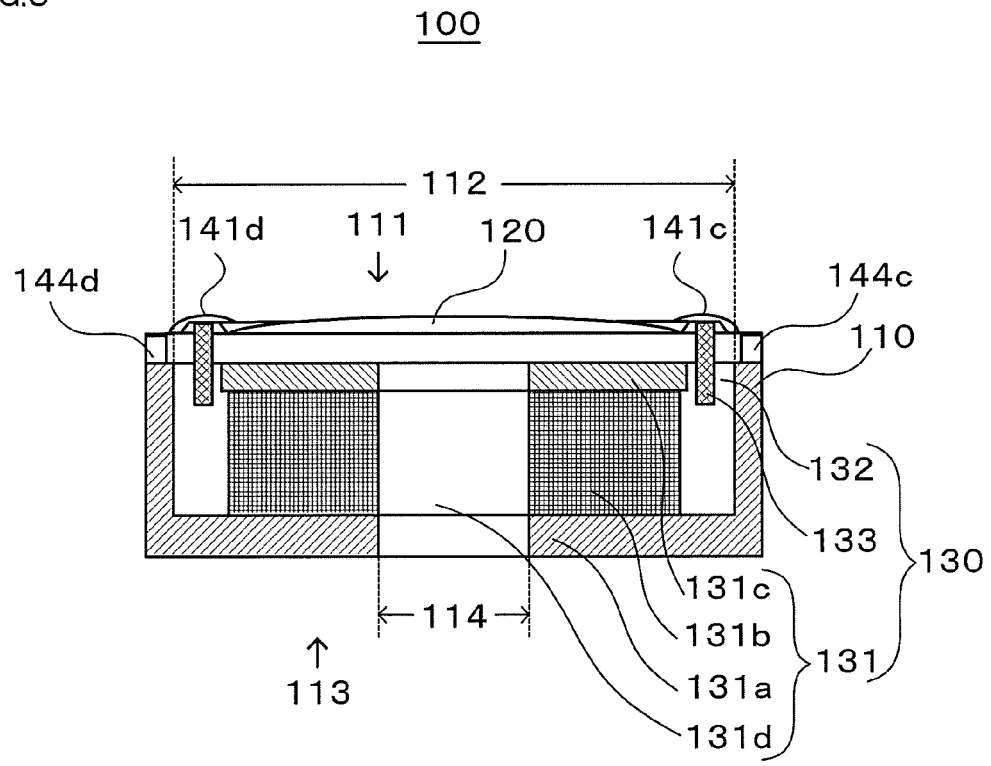
FIG. 3 is a sectional view (a sectional view taken along a line A-A' of FIG. 2) of the substantially center portion of the speaker 100.

FIG. 1 is an external view of a speaker 100 according to the first embodiment. FIG. 2 is a plan view of the speaker 100 according to the first embodiment. FIG. 3 is a sectional view (a sectional view taken along a line A-A' of FIG. 2) of the substantially center portion of the speaker 100.

As shown in FIGS. 1 through 3, the speaker 100 according to the first embodiment includes a housing 110, a diaphragm 120, a driving unit 130, and movable supports 140*a*, 140*b*, 140*c*, and 140*d*.

The housing 110 is a container having a rectangular prism shape that has a first main surface 111 having a square shape as shown in FIGS. 1 through 3. The housing 110 has, on the first main surface 111, a first opening portion 112 which is formed by the greater portion of the first main surface 111 being open, and has a second opening portion 114 which is a circular opening formed in a second main surface 113 on the side opposite to the first main surface 111 side. Although the material of the housing 110 may be, but is not limited to, a metal, a resin, or the like, the housing 110 is entirely made of a flexible magnetic material such as iron, because the housing 110 also serves as a yoke 131 a in the present embodiment. Note that, although not shown, the yoke and the housing can be separate components such that the housing holds the outer circumference of the yoke. In this case, the yoke constitutes a magnetic circuit, and consequently, is required to be made of the flexible magnetic materials such as iron. However, in a case where other parts, for example, corner parts for securing respective end portions of the movable supports, are formed as portions of the housing, the material thereof may be a nonmagnetic metal, a resin or the like. Moreover, the first main surface 111 has a substantially square shape in the present embodiment, but may have a rectangular shape, or another polygonal shape such as a triangular shape, a pentagonal shape, or a hexagonal shape except a quadrangular shape.

The diaphragm 120 is disposed in the first opening portion 112 and has a substantially disc shape which has the center portion slightly expanded, and which is similar to a dome shape. As shown in FIG. 2, the diaphragm 120 has a substantially round shape when viewed in a front direction in which the first main surface 111 is viewed in plan view. Preferably, the material of the diaphragm 120 is a paper, a lightweight metal foil having high rigidity such as aluminum or titanium, or high polymer film made of a polyimide or the like. Note that, although the diaphragm 120 has a substantially flat plate shape similar to a dome shape in the present embodiment to enhance rigidity, the rigidity may be enhanced by another shape, for example, a shape having concave and convex portions, and, if a material having high rigidity is used or a material is thick enough to hold the rigidity, the shape may not be a particular one that enhances rigidity, and may be a simple round-shaped flat plate. Moreover, the shape of the diaphragm 120 viewed in the front direction is not limited to a round shape and may be any shape if portions of the first main surface 111, except for the vicinity (hereinafter referred to as "corner regions") of each vertex of a polygonal shape in the first main surface 111, are covered. Here, each of the corner regions is located so as to be surrounded by the outer circumference of the diaphragm 120 and the vicinity of a corresponding one of the vertices formed by two sides forming the vertex of a polygonal shape in the first main surface 111. Accordingly, as shown in FIG. 2, the corner regions 115*a*, 115*b*, 115*c*, and 115*d* in the present embodiment exist at respective portions, in the first main surface 111 having the square shape, which are not covered with the diaphragm 120 having the round shape when viewed in the front direction in which the first main surface 111 is viewed in plan view.

The driving unit 130 causes the diaphragm 120 to vibrate so as to generate a sound corresponding to a signal inputted from the outside. As shown in FIG. 3, the driving unit 130 includes a magnetic circuit 131 disposed in the housing 110, a magnetic gap 132 provided in the magnetic circuit 131, and a voice coil 133 inserted in the magnetic gap 132.

The magnetic circuit 131 includes a yoke 131*a*, a magnet 131*b*, and a plate 131*c*, and has at least one sound hole 131*d* for emitting a sound to the second main surface 113 side. Here, the sound hole 131*d* extends through all of the yoke 131*a*, the magnet 131*b*, and the plate 131*c* in a direction perpendicular to the first main surface 111.

Note that, as described above, the yoke 131*a* also serves as the housing 110 in the present embodiment. However, the yoke 131*a* and the housing 110 may be components independent of each other. If the yoke and the housing are independent of each other, the sound hole 131*d* is adapted to extend through all of the yoke, the magnet, the plate, and the housing in the direction perpendicular to the first main surface 111.

The voice coil 133 is joined to the outer circumferential part of the diaphragm 120 so as to have an annular shape, and when an electric signal is inputted from the outside to the voice coil 133, the voice coil 133 receives force due to magnetic force in the magnetic gap 132 to cause the diaphragm 120 to vibrate, thereby generating a sound.

The movable supports 140*a* through 140*d* are disposed in the corner regions 115*a* through 115*d*, respectively, and include: elastic bodies 141*a*, 141*b*, 141*c*, and 141*d*; couplings 142*a*, 142*b*, 142*c*, and 142*d*; and spacers 144*a*, 144*b*, 144*c*, and 144*d*, respectively. The movable supports 140*a* through 140*d* support the diaphragm 120 by joining the housing 110 to the diaphragm 120 such that the diaphragm 120 is vibratable.

Each of the elastic bodies 141*a* through 141*d* is a suspension whose corresponding cross section perpendicular to the first main surface 111 has a substantially arc shape, and has elasticity along the corresponding cross section including a corresponding one of lines in directions extending between the housing 110 side and the diaphragm 120 side (directions indicated by each of dotted double-ended arrows a, b, c, and d in FIG. 2). Preferably, the material of the elastic bodies 141*a* through 141*d* is metal having a spring function, a resin, or the like.

Note that, if the first main surface 111 has a substantially square shape or rectangular shape as in the present embodiment, the elastic bodies 141*a* through 141*d* have substantially arc shapes in the corner regions 115*a* through 115*d* in the directions (the directions indicated by each of the dotted double-ended arrows a through d in FIG. 2) parallel to one of two sides forming a vertex of a rectangular shape in the first main surface 111. The elastic bodies 141*a* through 141*d* are disposed so as to have the elasticity in the directions. As a result, the movable supports 140*a* through 140*d* become movable and have the elasticity on a surface perpendicular to the first main surface 111 including the respective line in the directions (the directions indicated by each of the dotted double-ended arrows a through d in FIG. 2).

Also, in order to be efficiently disposed in the respective corner regions 115*a* through 115*d*, the elastic bodies 141*a* through 141*d* preferably have square shapes when viewed in the front direction in which the first main surface 111 is viewed in plan view, as shown in FIG. 2.

Moreover, the elastic bodies 141*a* through 141*d* and the diaphragm 120 may be integrally formed by using the same material, or may be integrally formed by using different materials.

Here, if the elastic bodies 141*a* through 141*d* are integrally formed with the diaphragm 120 by using the same material, reducing the width of the elastic bodies 141*a* through 141*d* or reducing the thickness thereof as compared to that of the diaphragm enables the reduction in stiffness of the elastic bodies 141*a* through 141*d*. Reducing the stiffness of the elastic bodies 141*a* through 141*d* in this manner reduces the lowest resonance frequency, thereby broadening the limitation of the bass reproduction. Alternatively, the use of the material having high rigidity for the diaphragm 120 or an increase of the thickness of the diaphragm 120 causes the rigidity of the diaphragm 120 to increase, thereby broadening the limitation of high-frequency reproduction.

On the contrary, in a case where the elastic bodies 141*a* through 141*d* are integrally formed by using a material different from that used for the diaphragm 120, forming the elastic bodies 141*a* through 141*d* using material more flexible than that of the diaphragm 120, or reducing the thickness of the component as compared to that of the diaphragm 120 enables the reduction in stiffness of the elastic bodies 141*a* through 141*d*. Reducing the stiffness of the elastic bodies 141*a* through 141*d* in this manner reduces the lowest resonance frequency, thereby broadening the limitation of the bass reproduction. Alternatively, the use of the material having high rigidity for the diaphragm 120 or an increase of the thickness of the diaphragm 120, or a refinement of the shape causes the rigidity of the diaphragm 120 to increase, thereby broadening the limitation of the high-frequency reproduction.

Each of the couplings 142*a* through 142*d* couples between the diaphragm 120 and the corresponding one of the elastic bodies 141*a* through 141*d*, and vibrates together with the diaphragm 120, and therefore also acts as a diaphragm. Moreover, the couplings 142*a*, 142*b*, 142*c*, and 142*d* have the respective ribs 143*a*, 143*b*, 143*c*, and 143*d* which are formed thereon to enhance the rigidity.

The spacers 144*a* through 144*d* are prism-shaped resins inserted between the perimeter of the first main surface 111 and the respective elastic bodies 141*a* through 141*d* such that appropriate spacing is maintained between the housing 110 and the diaphragm 120. Note that, the spacers 144*a* through 144*d* are not necessarily provided and may be integrally formed as a portion of the housing 110, or may be integrally formed as portions of the respective movable supports 140*a* through 140*d*.

<Summary>

When the round-shaped diaphragm is disposed on the main surface of the square-shaped housing, four corner regions of the main surface are usually dead spaces. The elastic bodies are disposed in these dead spaces, instead of the edge, which is included in a typical speaker, for supporting the outer circumferential part of the diaphragm, to partially support the diaphragm so that the diaphragm is disposed on the main surface of the housing in a maximally efficient manner, thereby enlarging the elastic bodies in limited spaces as well as maximally securing an effective vibrating area of the diaphragm.

As described above, the stiffness of the elastic body is reduced while reducing the speaker in size, and the lowest resonance frequency is reduced to broaden the limitation of the bass reproduction, thereby improving the bass characteristic to realize the wideband reproduction.

[First Variation]

<Overview>

A first variation is a speaker in which a magnetic fluid is filled in a gap between the voice coil 133 and the plate 131*c* in the speaker 100 of the first embodiment.

<Configuration>

Figure 4:
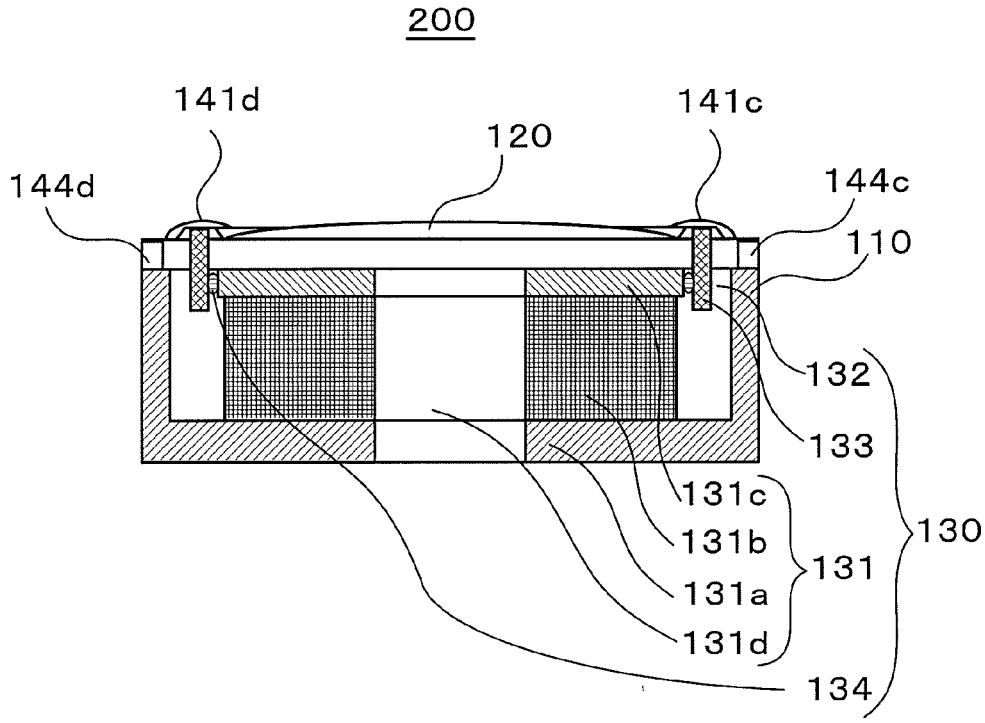
FIG. 4 is a sectional view (corresponding to the sectional view taken along the line A-A' of FIG. 2) of the substantially center portion of a speaker 200.

An external view and plan view of a speaker 200 according to the first variation are similar to FIGS. 1 and 2, respectively, according to the first embodiment. FIG. 4 is a sectional view (corresponding to the sectional view taken along the line A-A' of FIG. 2) of the substantially center portion of the speaker 200.

The speaker 200 shown in FIG. 4 differs from the speaker 100 shown in FIG. 3 in that a magnetic fluid 134 is filled in a gap between the voice coil 133 and the plate 131*c*.

The magnetic fluid 134 is held by magnetic force in a magnetic gap, which is the gap between the voice coil 133 and the plate 131*c*, and forms a fluid O-ring. Here, the magnetic fluid is a magnetic colloid solution containing: ferromagnetic particles (having a diameter of about 10 nm) such as magnetite or manganese zinc ferrite; a surface active agent for covering the surfaces of the ferromagnetic particles; and a base liquid such as water or an oil. Although the magnetic fluid is a liquid, the magnetic fluid has magnetic property and is attracted by a magnet.

In addition, the magnetic fluid has center-holding capability. Thus, even when the diaphragm 120 vibrates to a great extent, the center-holding capability of the magnetic fluid 134 allows the diaphragm 120 and the voice coil 133 to vibrate in a stable state without contacting the yoke 131*a* and/or the plate 131*c*.

Also, the magnetic fluid 134 filled in the gap between the voice coil 133 and the magnetic gap 132 blocks sound leakage from this gap, and therefore the sound can be efficiently emitted from the speaker.

Note that, if the shape of the voice coil includes an angular portion having radius curvature of less than or equal to about 1 mm, the magnetic fluid, in general, has a property to creep up the angular portion. Since, if the creep-up of the magnetic fluid occurs, the sound starts leaking to cause the sound pressure of the sound emitted through the sound hole 131*d* to be reduced, or cause the center-holding capability to be reduced. Therefore, the voice coil needs to have a shape which does not have an angle corresponding to a radius curvature which is less than or equal to about 1 mm. In the first variation, the diaphragm 120 is formed in a round shape as well as the voice coil 133 joined to the outer circumferential part of the diaphragm 120.

[Second Variation]

<Overview>

A second variation is a speaker in which the gap between the voice coil 133 and the plate 131*c* is less than or equal to 50 μm in the speaker 100 of the first embodiment.

<Configuration>

Figure 5:
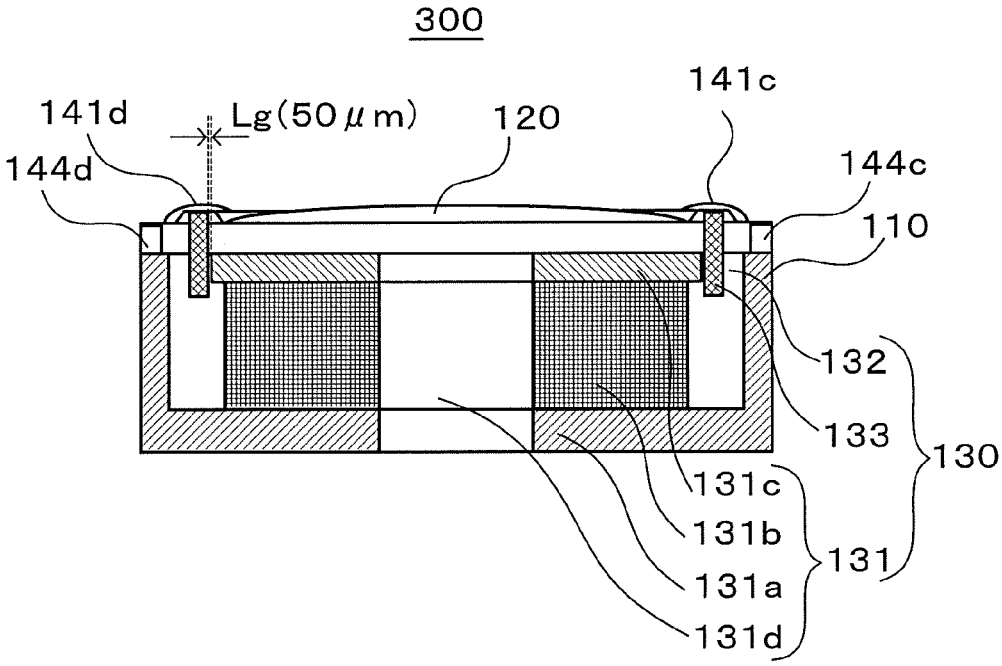
FIG. 5 is a sectional view (corresponding to the sectional view taken along the line A-A' of FIG. 2) of the substantially center portion of a speaker 300.
Figure 6:
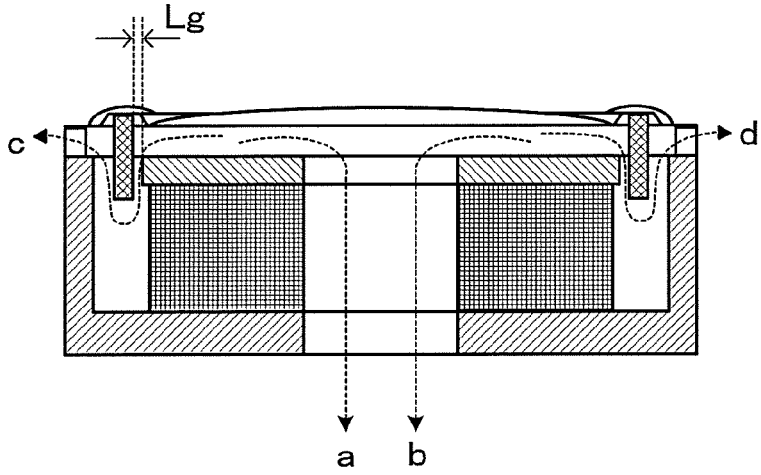
FIG. 6 is a diagram (corresponding to the sectional view taken along the line A-A' of FIG. 2) illustrating features of a second variation.

An external view and plan view of a speaker 300 according to the second variation are similar to FIGS. 1, and 2, respectively, according to the first embodiment. FIG. 5 is a sectional view (corresponding to the sectional view taken along the line A-A' of FIG. 2) of the substantially center portion of the speaker 300. FIG. 6 is a diagram (corresponding to the sectional view taken along the line A-A' of FIG. 2) illustrating features of the second variation.

The speaker 300 shown in FIG. 5 differs from the speaker 100 shown in FIG. 3 in that, while the speaker 100 has a gap Lg of about 150 μm between the voice coil 133 and the plate 131*c*, which is of comparable width as that of an ordinary speaker, the speaker 300 has the gap Lg of 50 μm.

In FIG. 6, sounds to the rear side of the diaphragm (sounds indicated by each of dotted arrows a and b in FIG. 6) are emitted through a sound hole provided at the center portions of the center pole, the magnet, and the yoke, and transmitted to user's ears.

Here, the gap between the inner circumferential part of the voice coil and the outer circumferential part of the plate is acoustically open. Thus, some of the sounds (leaked sounds indicated by each of dotted arrows c and d in FIG. 6) to the rear of the diaphragm pass through this gap, and escapes to a front portion of the diaphragm, which decreases the sound pressure level required for intended sound reproduction.

Figure 7:
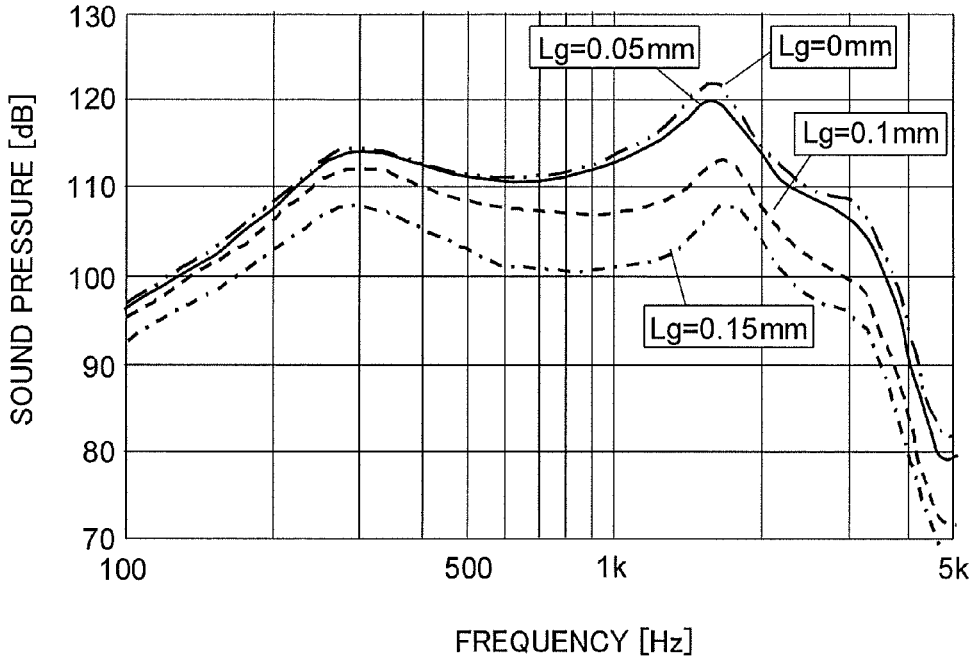
FIG. 7 is a diagram showing results, obtained by simulation computation, of relation between the width of a gap Lg and a sound pressure frequency characteristic.

FIG. 7 is a diagram showing results, obtained by simulation computation, of relation between the width of the gap Lg and a sound pressure frequency characteristic. Here, the following speaker-constants are used for the computation: weight of vibration system is 1.32 mg; the radius of the diaphragm is 2.83 mm; force coefficient is 0.33; electrical impedance of the voice coil is 32Ω; and the diameter of a sound hole at the center portion of the center pole is ϕ1 mm.

The acoustic coupler is defined by International telecommunication union (ITU) standard. Specifically, three types of the acoustic couplers, which are Type 1, Type 3.2 low-leak, and Type 3.2 hi-leak, are generally used. In each of these acoustic couplers, a small empty chamber is provided, and a microphone is mounted in this empty chamber. This microphone is used to measure the characteristic of the sound pressure frequency from the receiver during the reproduction. The Type 1 acoustic coupler is a model for a case where a state is assumed where no sound leakage occurs and the empty chamber is completely closed. In the Type 1 acoustic coupler, the empty chamber is completely closed with the receiver mounted therein. Therefore, the sound pressure frequency characteristic becomes substantially flat at the bass lower than or equal to the lowest resonance frequency of the receiver. On the other hand, the acoustic couplers of the two types of Type 3.2 are models for a case where a state is assumed where the sound leakage occurs. Although the sound leakage is small in the Type 3.2 low-leak acoustic coupler, the number of sound holes is increased in the Type 3.2 hi-leak acoustic coupler, which leads to an increased amount of the sound leakage.

Therefore, as the measurement conditions of the sound pressure frequency characteristic, the use of the Type 3.2 hi-leak acoustic coupler defined by International telecommunication union (ITU) standard is assumed.

In FIG. 7, the sound pressure frequency characteristics under four conditions are shown, which satisfy the gap Lg (mm)=0.15, 0.10, 0.05, or 0 (the gap Lg (mm)=0 mm represents a condition where no gap is provided and no sound leakage occurs). According to FIG. 7, it is understood that, in a case where Lg=0.15 is satisfied, the sound pressure level is greatly reduced across all bands because of the leaked sounds c and d. As the Lg becomes smaller, the width of the gap through which the sound passes is reduced. Thus, the acoustic impedance produced by the gap is increased so much as it is difficult for the leaked sounds to pass through the gap. Consequently, most of the sounds to the rear of the diaphragm pass through the sound hole at the center portion of the center pole. FIG. 7 also shows a sound pressure frequency characteristic in a case where the width of the gap virtually satisfies Lg=0. According to FIG. 7, it is understood that, if the width of the gap is narrowed so as to satisfy Lg=0.05 mm, the sound pressure frequency characteristic which is comparable as the case where the width of the gap satisfies Lg=0 can be obtained. Therefore, preferably, the gap between the voice coil 133 and the plate 131*c* is less than or equal to 50 μm.

On the other hand, if the width of the gap is thus narrowed, a possibility increases that, when the diaphragm vibrates to a great extent at bass reproduction, the inner circumferential part of the voice coil contacts with the outer circumferential part of the center pole, causing an abnormal sound or damage of the voice coil and/or the center pole. Therefore, it is preferable that the magnetic fluid is injected in the entirety or a portion of this gap to prevent the contact between the inner circumferential part of the voice coil and the outer circumferential part of the center pole.

Here, since the viscosity is important as a condition to be satisfied by the material of the magnetic fluid, the following shows the results of a study on the viscosity of the magnetic fluid in the speaker 200 according to the first variation.

Figure 8:
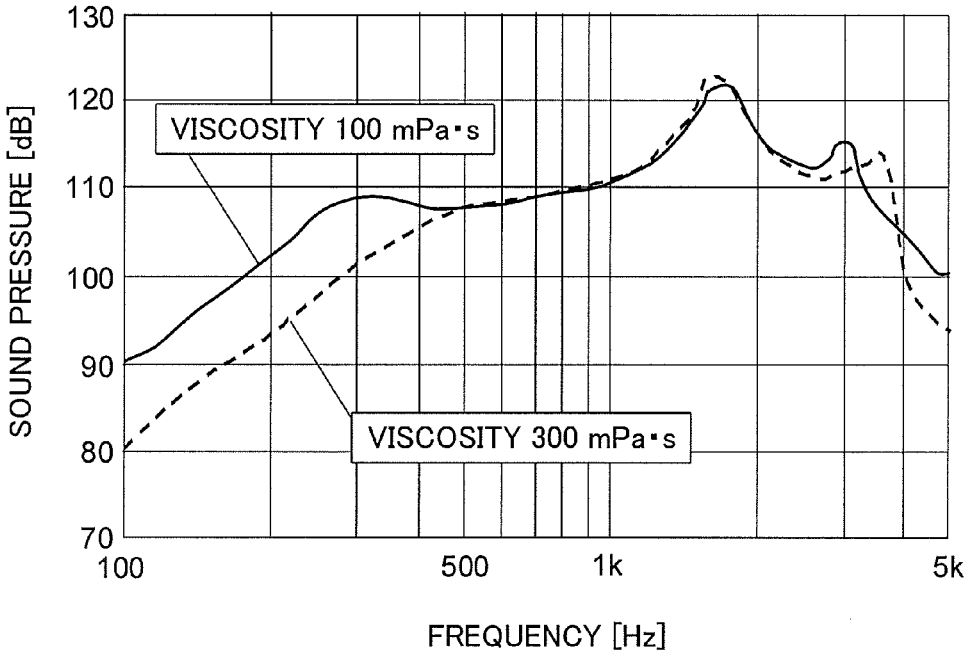
FIG. 8 is a diagram showing relation between viscosity of a magnetic fluid and the sound pressure frequency characteristic.

FIG. 8 is a diagram showing relation between the viscosity of the magnetic fluid and the sound pressure frequency characteristic. A speaker used here has the speaker-constants equivalent to those of the speaker used for the simulation computation in the second variation.

In FIG. 8, when a case where the magnetic fluid has the viscosity of 100 mPas is compared with a case where the magnetic fluid has the viscosity of 300 mPas, sound pressure levels in both cases have little difference at 500 Hz to 3 kHz. However, at around 100 Hz to 300 Hz, the sound pressure level obtained when the magnetic fluid has the viscosity of 100 mPas, is higher by about 10 dB than the sound pressure level obtained when the magnetic fluid has the viscosity of 300 mPas. Thus, it is understood that, in the case where the magnetic fluid has the viscosity of 100 mPas, the bass is richly reproduced and the sound quality of the reproduction sound is excellent.

Accordingly, preferably, the magnetic fluid here has the viscosity of 100 mPas.

[Second Embodiment]

<Overview>

A second embodiment is a speaker, which has a diaphragm having a substantially track shape perimeter disposed on a substantially rectangular-shaped main surface of a housing, and which includes movable supports, instead of the edge of the conventionally used typical speaker, in the vicinity of respective vertices of the main surface for joining the housing to the diaphragm such that the diaphragm is vibratable.

<Configuration>

Figure 9:
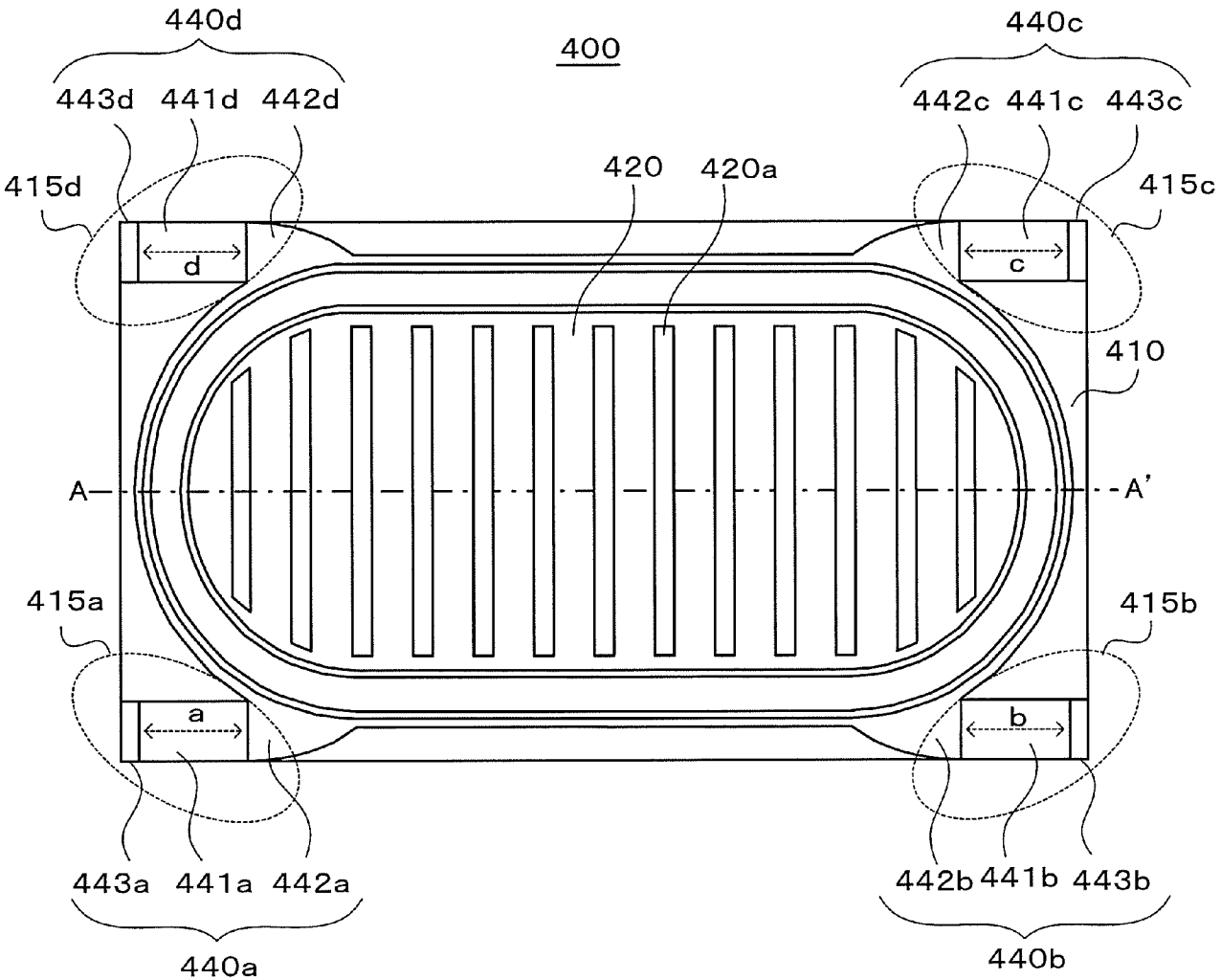
FIG. 9 is a plan view of a speaker 400 according to a second embodiment.
Figure 10:
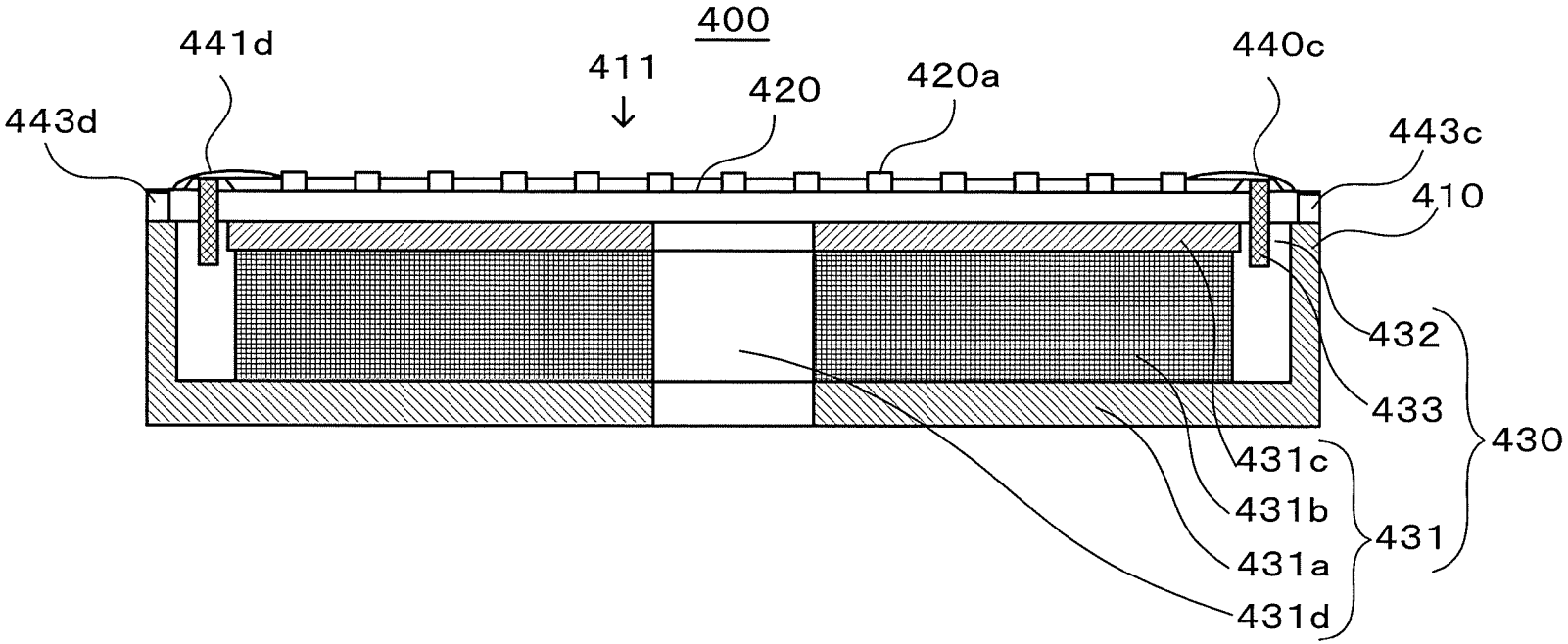
FIG. 10 is a sectional view (corresponding to a sectional view taken along a line A-A' of FIG. 9) of the substantially center portion of the speaker 400.

FIG. 9 is a plan view of a speaker 400 according to the second embodiment. FIG. 10 is a sectional view (corresponding to a sectional view taken along a line A-A' of FIG. 9) of the substantially center portion of the speaker 400.

The speaker 400 according to the second embodiment includes a housing 410, a diaphragm 420, a driving unit 430, and movable supports 440*a*, 440*b*, 440*c*, and 440*d*.

The speaker 400 shown in FIG. 9 differs from the speaker 100 shown in FIG. 2 mainly in that the external shape of the speaker 400 is an elongated shape having long sides and short sides and that the shape of the diaphragm has a substantially track shape perimeter. Other basic configurations are almost the same.

The housing 410 is similar in function to the housing 110 of the first embodiment, and is a container having a rectangular prism shape and has a first main surface 411 having a rectangular shape.

The diaphragm 420 is similar in function to the diaphragm 120 of the first embodiment, and is a substantially flat plate having a track shape perimeter in the shape of a 400-meter-track used for track and field when viewed, for example, in a front direction in which the first main surface 411 is viewed in plan view as shown in FIG. 9. The diaphragm 420 is provided with ribs 420*a* that are long in a short side direction (a direction parallel to the short sides of the first main surface 411), enhancing the rigidity particularly in the short side direction by the concavity and convexity of the ribs.

The driving unit 430 is similar in function to the driving unit 130 of the first embodiment, and has an elongated shape. As shown in FIG. 10, the driving unit 430 causes the diaphragm 420 to vibrate so as to generate a sound corresponding to a signal inputted from the outside, and includes a magnetic circuit 431 disposed in the housing 411, a magnetic gap 432 provided in the magnetic circuit 431, and a voice coil 433 inserted in the magnetic gap 432.

The magnetic circuit 431 includes a yoke 431*a*, a magnet 431*b*, and a plate 431*c*, and has at least one sound hole 431*d* for emitting a sound to the side opposite to the first main surface 411. Here, the sound hole 431*d* extends through all of the yoke 431*a*, the magnet 431*b*, and the plate 431*c* in a direction perpendicular to the first main surface 411.

Note that, the yoke 431*a* also serves as the housing 410 in the present embodiment.

The voice coil 433 is joined to the outer circumferential part of the diaphragm 420 so as to have a track shape, and when an electric signal is inputted from the outside into the voice coil 433, the voice coil 433 receives force due to magnetic force in the magnetic gap 432 to cause the diaphragm 420 to vibrate, thereby generating a sound.

The movable supports 440*a*, 440*b*, 440*c*, and 440*d* are similar in function to the movable supports 140*a*, 140*b*, 140*c*, and 140*d* of the first embodiment, respectively, and are efficiently disposed in respective corner regions 415*a*, 415*b*, 415*c*, and 415*d*. The movable supports 440*a*, 440*b*, 440*c*, and 440*d* include: elastic bodies 441*a*, 441*b*, 441*c*, and 441*d*; the couplings 442*a*, 442*b*, 442*c*, and 442*d*; and spacers 443*a*, 443*b*, 443*c*, and 443*d*, respectively. The elastic bodies 441*a* through 441*d* are similar in function to the elastic bodies 141*a* through 141*d* of the first embodiment, respectively. The couplings 442*a* through 442*d* are similar in function to the couplings 142*a* through 142*d* of the first embodiment, respectively. The spacers 443*a* through 443*d* are similar in function to the spacers 144*a* through 144*d* of the first embodiment, respectively.

Note that, in the present embodiment, although directions in which the elastic bodies 441*a*, 441*b*, 441*c*, and 441*d* have the elasticity are substantially matched with directions parallel to long sides of the first main surface 411 (directions indicated by each of the respective dotted double-ended arrows a, b, c, and d in FIG. 9) as shown in FIG. 9, the directions in which the elastic bodies 441*a*, 441*b*, 441*c*, and 441*d* have the elasticity may be substantially matched with directions parallel to short sides of the first main surface 411 (directions perpendicular to each of the respective dotted double-ended arrows a through d in FIG. 9).

Moreover, the diaphragm 420 may be a substantially flat plate having an elliptical shape, which looks like an elliptical shape when viewed from the front direction in which the first main surface 411 is viewed in plan view.

Figure 11:
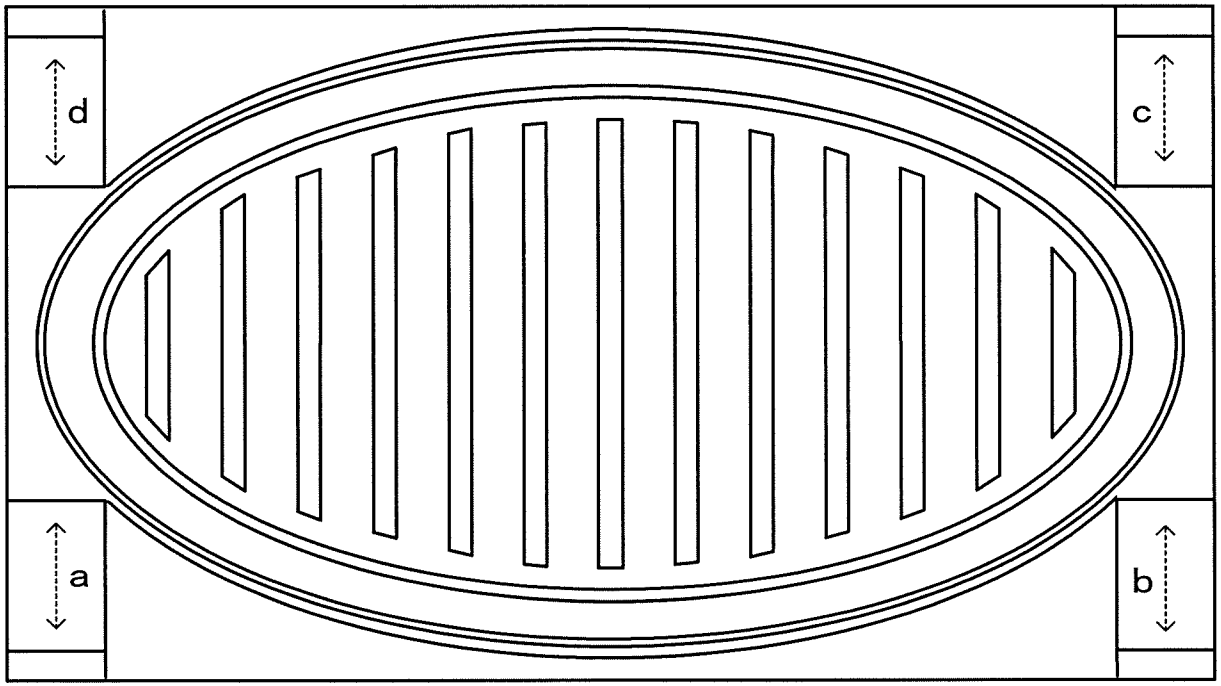
FIG. 11 is a plan view of a speaker in a case where the shape of a diaphragm 420 is changed from a shape having a track shape perimeter to an elliptical shape.

FIG. 11 is a plan view of a speaker in a case where the shape of the diaphragm 420 is changed from a shape having a track shape perimeter to an elliptical shape.

As shown in FIG. 11, if the shape of the diaphragm 420 is changed from the shape having a track shape perimeter to a elliptical shape, although the area of the diaphragm is slightly reduced, dead spaces in the respective corner regions expand in a short side direction (a short side direction of the diaphragm) of the first main surface 411. Accordingly, it is preferable, that the directions, in which the elastic bodies 441*a* through 441*d* have the elasticity, are substantially matched with the directions (the directions of each of the respective dotted double-ended arrows a, b, c, and d in FIG. 11) parallel to the short sides of the first main surface 411, and the width of the suspension in a long side direction is enlarged, thereby broadening the limitation of the bass reproduction.

Further, configurations of the first variation, and the second variation are applicable to the present embodiment.

Figure 12:
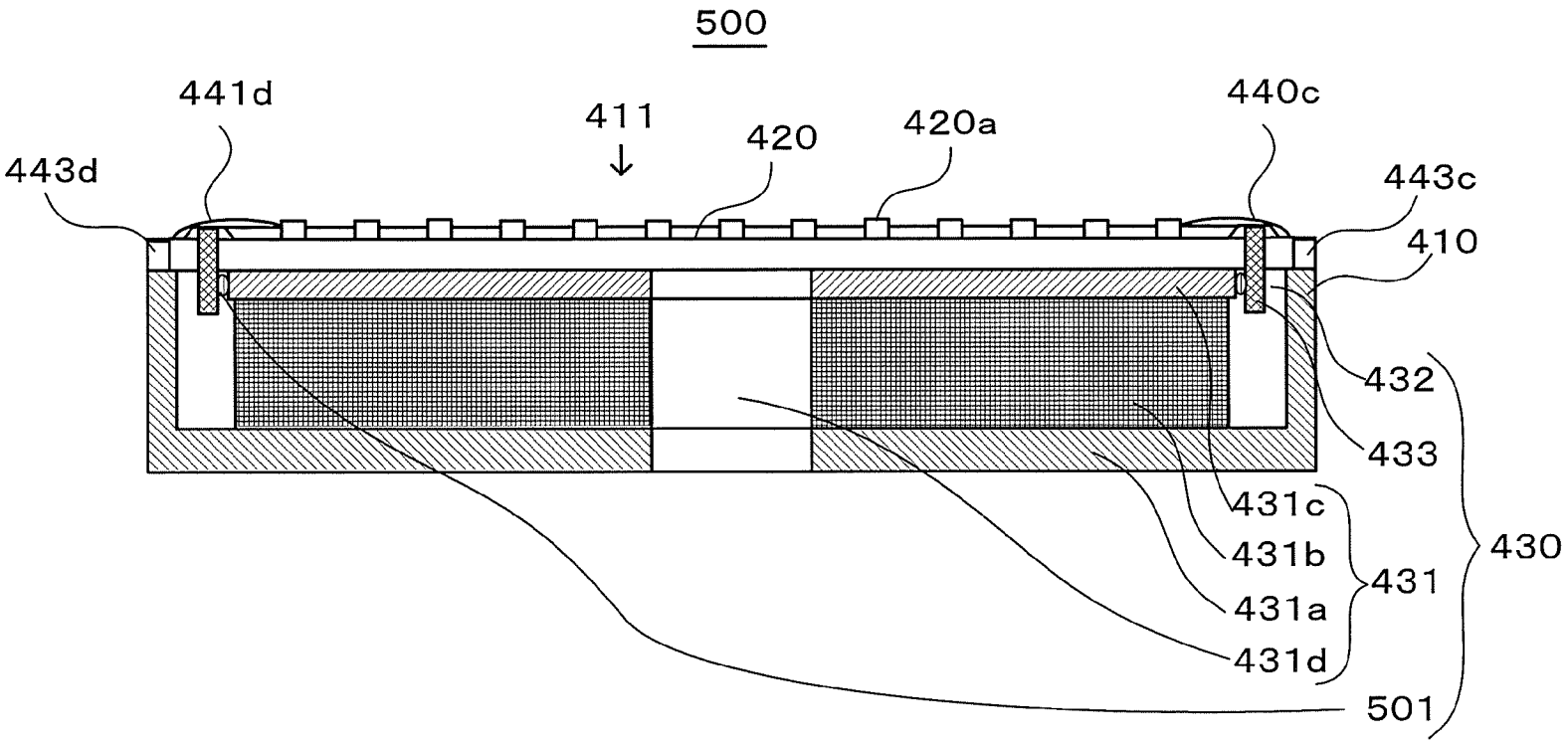
FIG. 12 is a sectional view (corresponding to the sectional view taken along the line A-A' of FIG. 9) of the substantially center portion of a speaker 500.
Figure 13:
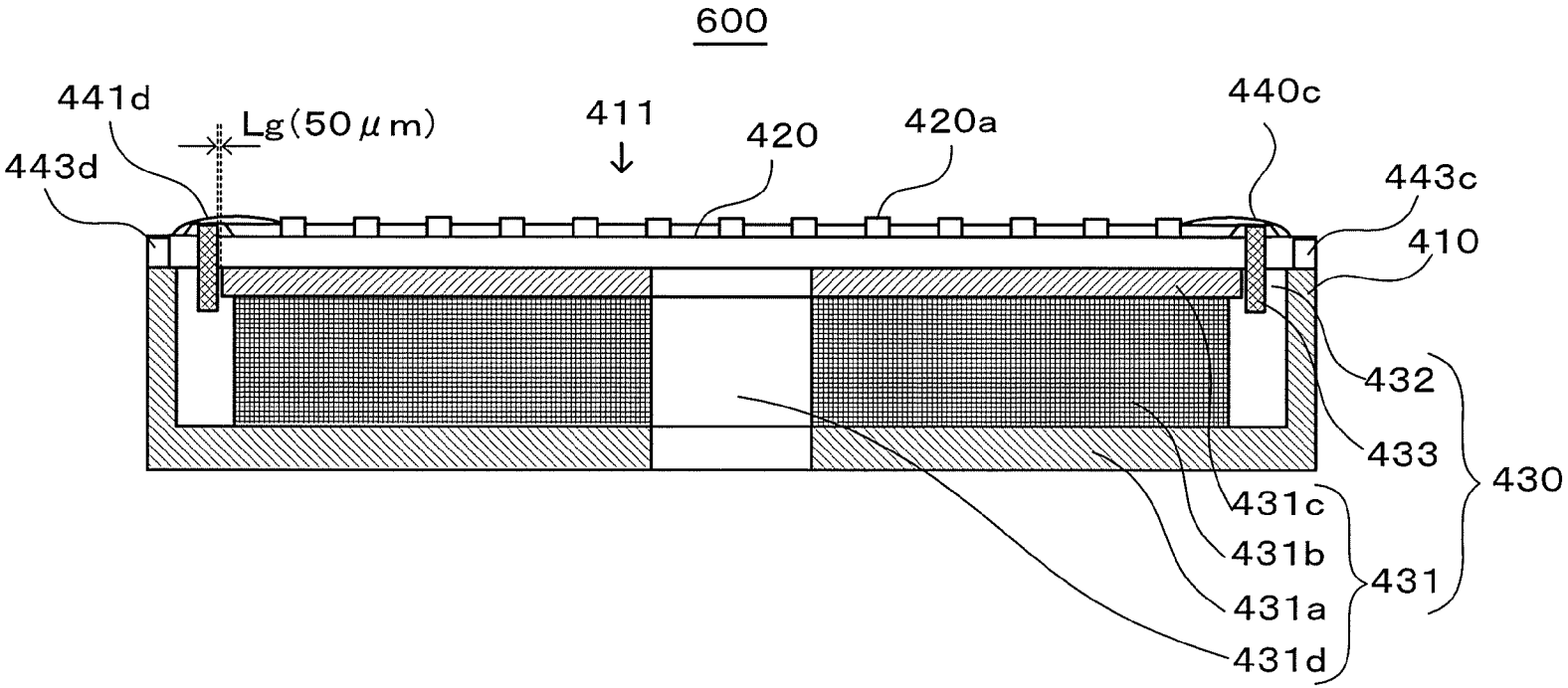
FIG. 13 is a sectional view (corresponding to the sectional view taken along the line A-A' of FIG. 9) of the substantially center portion of a speaker 600.

External views and plan views of a speaker 500 in which the first variation is applied to the second embodiment, and a speaker 600 in which the second variation is applied to the second embodiment, are similar to FIGS. 1 and 2, respectively, according to the first embodiment. FIG. 12 is a sectional view (corresponding to the sectional view taken along the line A-A' of FIG. 9) of the substantially center portion of the speaker 500. FIG. 13 is a sectional view (corresponding to the sectional view taken along the line A-A' of FIG. 9) of the substantially center portion of the speaker 600.

The speaker 500 shown in FIG. 12 differs from the speaker 400 shown in FIG. 10 in that a magnetic fluid 501 is filled in a gap between the voice coil 433 and the plate 431*c*.

The magnetic fluid 501 is similar in function to the magnetic fluid 134 of the first variation.

The speaker 600 shown in FIG. 13 is a speaker in which the gap Lg between the voice coil 433 and the plate 431*c* of the speaker 400 shown in FIG. 10 is narrowed to about 50 μm.

<Summary>

For example, a receiver, which is disposed above a liquid crystal screen in a housing of a mobile phone, needs to be installed in a very narrow elongated space, and therefore needs to have a slim shape. If the housing of the receiver is formed in a rectangular shape to achieve the slim shape, the diaphragm is formed so as to have a substantially track shape perimeter or in a substantially elliptical shape in accordance with the housing, thereby efficiently securing the effective vibrating area. Also, the voice coil formed in a shape having a substantially track shape perimeter or a substantially elliptical shape allows elimination of angular corner portions of the voice coil, thereby preventing the creep-up of the magnetic fluid.

Further, the diaphragm formed in a shape having a substantially track shape perimeter or a substantially elliptical shape reduces the rigidity in the short side direction as compared to that in the long side direction. Thus, a plurality of long ribs are provided on the diaphragm in the short side direction of the diaphragm to enhance the rigidity of the diaphragm in the short side direction, thereby broadening the limitation of the high-frequency reproduction.

As described above, if the housing of the speaker is formed in a rectangular shape and the diaphragm is formed in a shape having a substantially track shape perimeter or is formed in a substantially elliptical shape, the limitation of the bass reproduction can be broadened by maximally securing the effective vibrating area of the diaphragm, while reducing in size and sliming down the speaker.

[Third Embodiment]

<Overview>

A speaker of a third embodiment is different from the speaker 100 of the first embodiment in the dispositions of the movable supports.

<Configuration>

Figure 14:
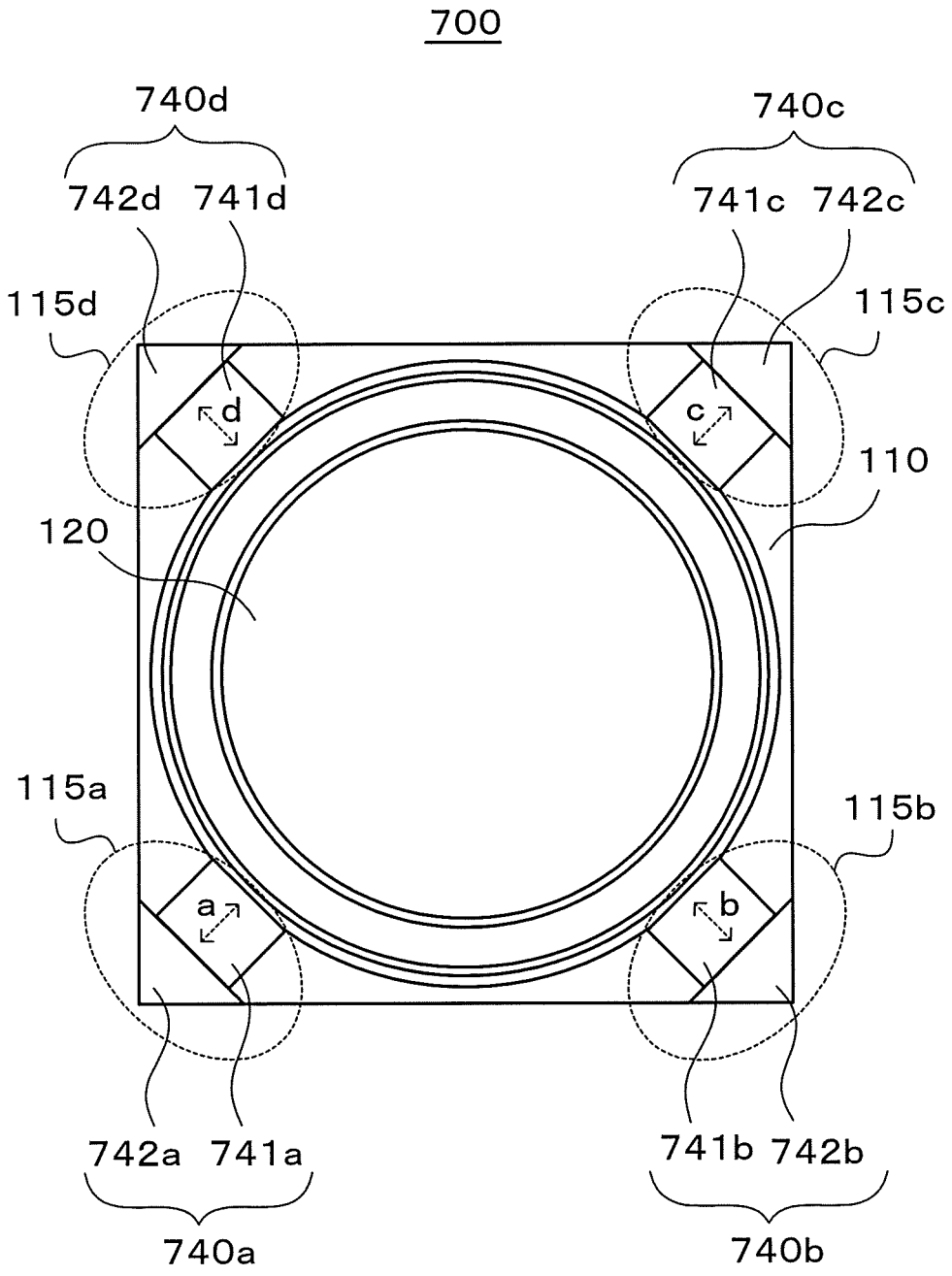
FIG. 14 is a plan view of a speaker 700 according to a third embodiment.

FIG. 14 is a plan view of a speaker 700 according to the third embodiment.

The speaker 700 according to the third embodiment includes the housing 110, the diaphragm 120, the driving unit 130, and movable supports 740*a*, 740*b*, 740*c*, and 740*d*. Here, same reference numerals are given to the components in the speaker 700 that are similar to those in the speaker 100 according to the first embodiment, and the description thereof is omitted.

The speaker 700 shown in FIG. 14 differs from the speaker 100 shown in FIG. 2 in that the movable supports 140*a* through 140*d* are replaced with the movable supports 740*a* through 740*d*, respectively, and the other components are the same.

The movable supports 740*a*, 740*b*, 740*c*, and 740*d* are similar in function to the movable supports 140*a*, 140*b*, 140*c*, and 140*d* of the first embodiment, respectively, and are efficiently disposed in respective corner regions 115*a*, 115*b*, 115*c*, and 115*d*. The movable supports 740*a*, 740*b*, 740*c*, and 740*d* include: elastic bodies 741*a*, 741*b*, 741*c*, and 741*d;* and spacers 742*a*, 742*b*, 742*c*, and 742*d*, and exclude components like the couplings 142*a*, 142*b*, 142*c*, and 142*d* of the first embodiment, respectively.

The elastic bodies 741*a* through 741*d* are similar in function to the elastic bodies 141*a* through 141*d* of the first embodiment, but disposed in different directions from those in which the elastic bodies 141*a* through 141*d* are disposed, respectively.

Each of the elastic bodies 741*a* through 741*d* is disposed so as to have a substantial arc shape in corresponding diagonal directions of the first main surface 111, or in directions of the bisector of an angle formed by corresponding two sides forming a corresponding vertex in the first main surface 111 (directions indicated by each of dotted double-ended arrows a, b, c, and d in FIG. 14), thereby having elasticity in the corresponding directions of the substantial arc shape. As a result, the movable supports 740*a* through 740*d* become movable and have the elasticity on the surface perpendicular to the first main surface 111 including respective lines in the directions (the directions indicated by each of the dotted double-ended arrows a through d in FIG. 14), respectively.

The spacers 742*a* through 742*d* are similar in function to the respective spacers 144*a* through 144*d* of the first embodiment. The elastic bodies 741*a* through 741*d*, however, are disposed in the different directions from those in which the elastic bodies 141*a* through 141*d* are disposed, respectively. Correspondingly, the spacers 742*a* through 742*d* differ from the spacers 144*a* through 144*d* in shape, and are here shaped in triangular prisms.

Note that, the directions in which each of the elastic bodies 741*a* through 741*d* has the elasticity is not limited to the corresponding diagonal directions of the first main surface 111, or the corresponding directions of the bisector of the angle formed by the two sides forming the vertex in the first main surface 111 (the directions indicated by each of the dotted double-ended arrows a, b, c, and d in FIG. 14). The directions in which each of the elastic bodies 741*a* through 741*d* has the elasticity may be any other directions as long as the directions allow the width of each elastic bodies 741*a* through 741*d* in the long side direction to be enlarged, and the diaphragm 120 to be supported.

Further, the movable supports 740*a* through 740*d* as in the present embodiment can be applied to the speaker of the second embodiment which includes the diaphragm having a track shape perimeter or an elliptical shape.

Figure 15:
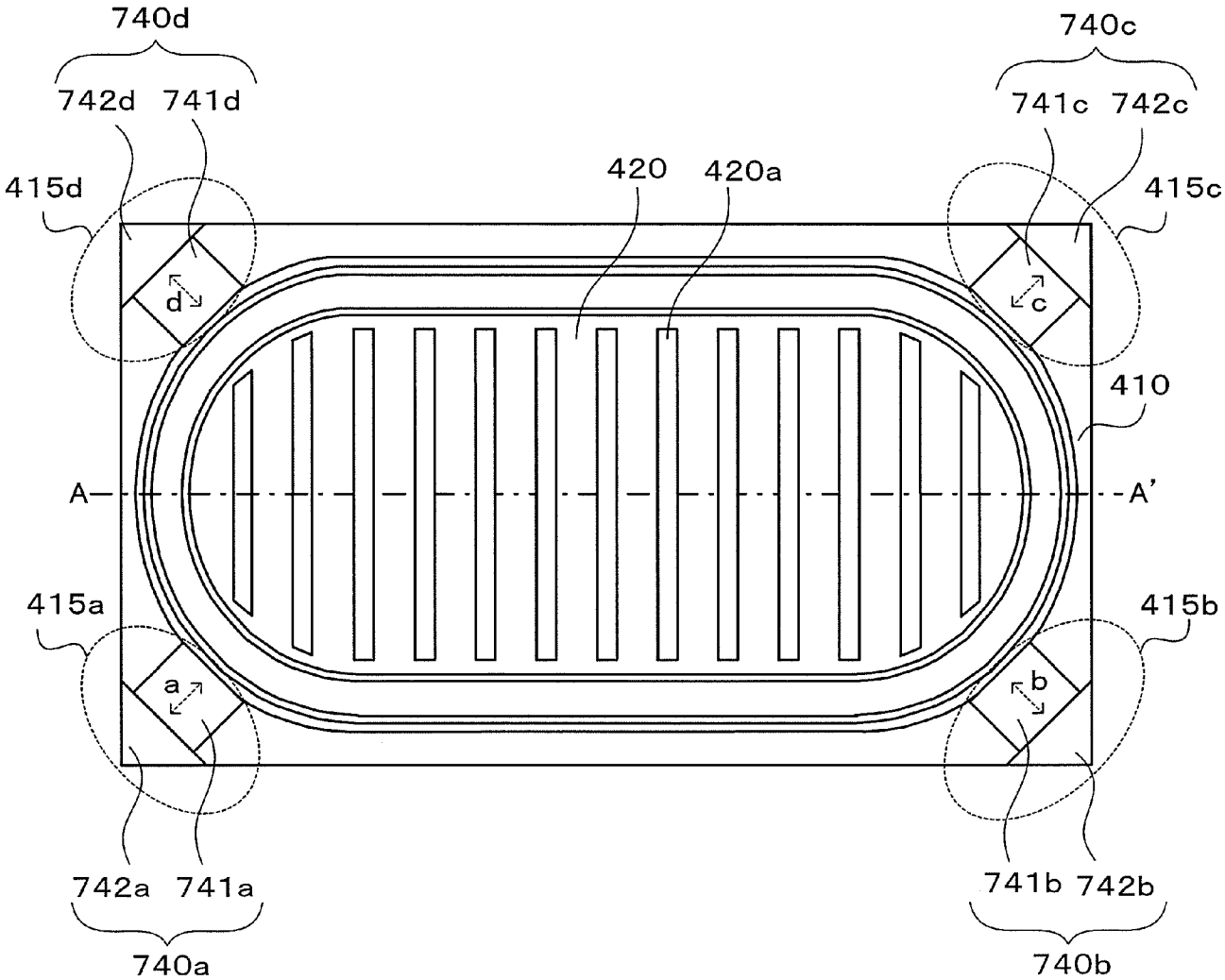
FIG. 15 is a diagram showing an example in which movable supports described in the third embodiment are applied to the speaker including a diaphragm having a track shape perimeter described in the second embodiment.

FIG. 15 is a diagram showing an example in which the movable supports described in the present embodiment are applied to the speaker including the diaphragm having a track shape perimeter described in the second embodiment.

Figure 16:
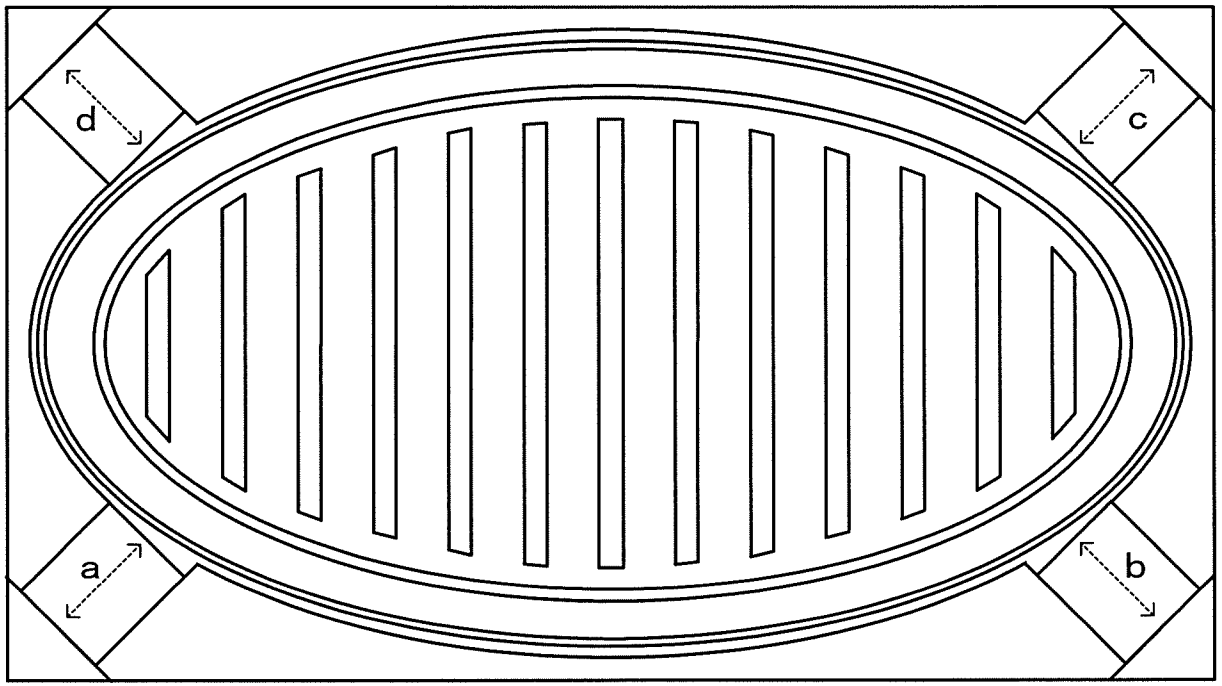
FIG. 16 is a diagram showing an example in which the movable supports described in the third embodiment are applied to the speaker including a diaphragm having a elliptical shape described in the second embodiment.

FIG. 16 is a diagram showing an example in which the movable supports described in the present embodiment are applied to the speaker including the diaphragm having a elliptical shape described in the second embodiment.

Alternatively, the configuration of any one of the first variation and the second variation are applicable to the present embodiment.

<Summary>

Each of the elastic bodies are disposed so as to have the elasticity at the corresponding diagonal direction angle, or in the corresponding directions of the bisector of the vertex, and thus the width of suspension in the long side direction can be enlarged in the limited space. Enlarging the width of the elastic body in the long side direction reduces the stiffness of the elastic body, thereby broadening the limitation of the bass reproduction.

[Fourth Embodiment]

<Overview>

In a fourth embodiment, a description is given of an example where the speaker according to any of the embodiments described above is mounted in a hearing aid, and its effects.

<Configuration>

Figure 17:
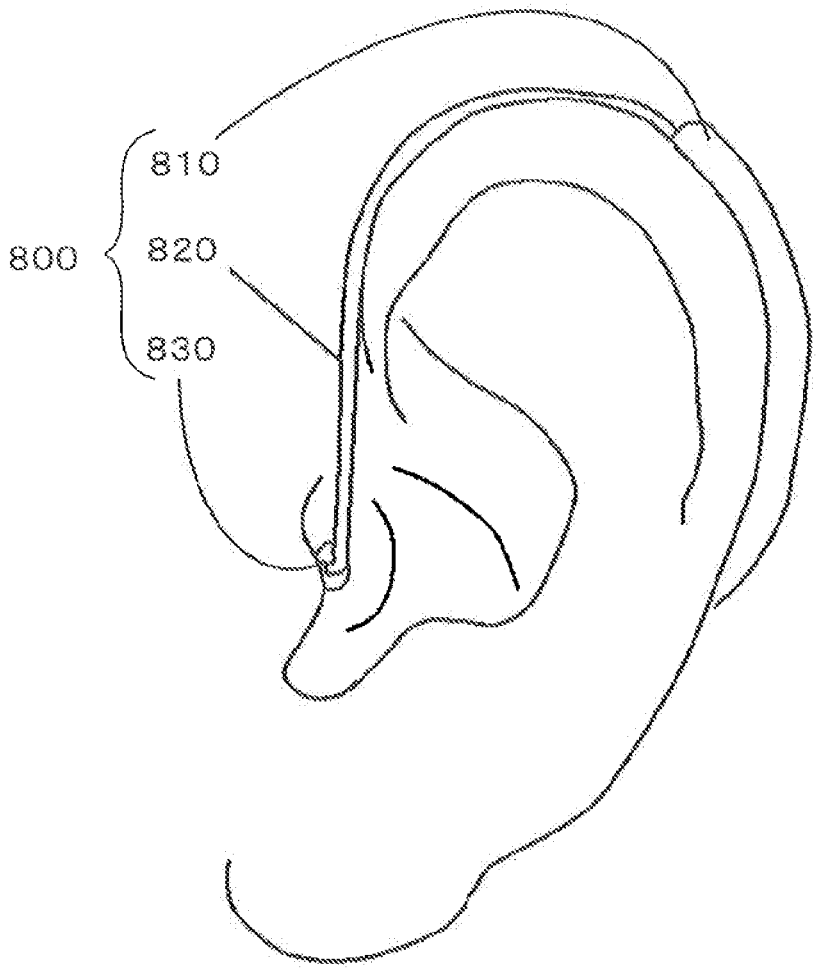
FIG. 17 is a diagram showing usage of the speaker according to any of the embodiments described herein, which is mounted in a hearing aid.

FIG. 17 is a diagram showing usage of the speaker according to any of the embodiments described above, which is mounted in a hearing aid.

A hearing aid 800 shown in FIG. 17 has the speaker 200, mounted therein, which is described in the first variation of the first embodiment, and is used by being worn behind a user's ear. The hearing aid 800 includes a hearing aid body 810, a leading tube 820, and a receiver 830.

The hearing aid body 810 includes a microphone (not shown). The hearing aid body 810 acquires, using this microphone, speaker's voice, and ambient sounds, converts the acquired voice and sounds into electric signals, performs signal processing to optimize the electric signals so as to be suitable for the user's hearing characteristic, further amplifies, and then outputs the resultant electric signals.

The leading tube 820 includes therein an electric wire (not shown), and wires the electric signal outputted from the hearing aid body 810 to the receiver 830.

The receiver 830 includes the speaker 200 (see FIGS. 1, 2, and 4) described in the first variation of the first embodiment, and converts into a sound the electric signal wired via the electric wire in the leading tube 820.

Figure 18:
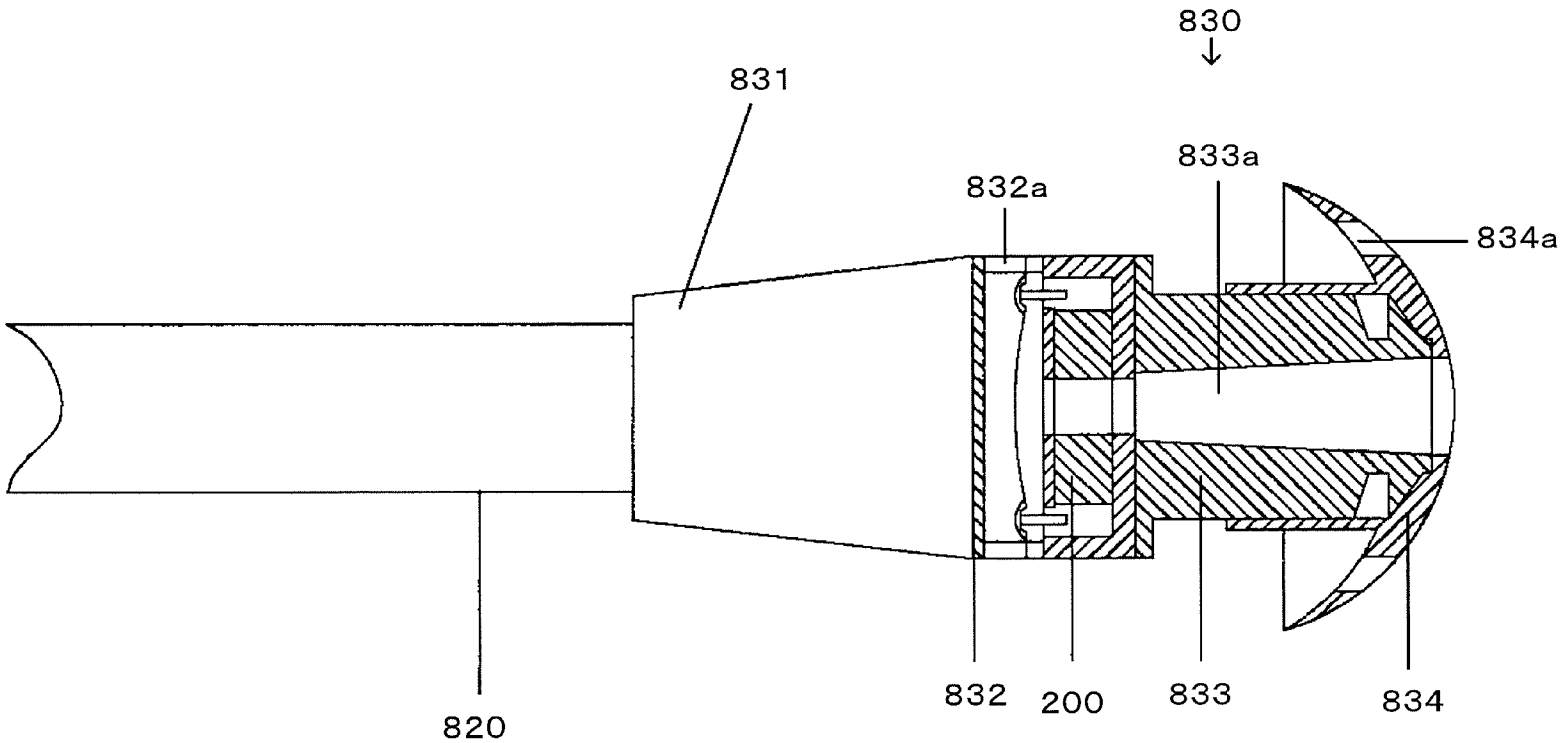
FIG. 18 is a diagram showing in detail a receiver 830.

FIG. 18 is a diagram showing in detail the receiver 830. Note that, in FIG. 18, a portion of the leading tube 820 is depicted, and components of the receiver 830 other than the leading tube joining part 831 are shown in cross section.

As shown in FIG. 18, the receiver 830 is formed of the speaker 200, the leading tube joining part 831, a rear cover 832, an ear tip joining part 833, and an ear tip 834.

Here, the rear cover 832 is disposed behind the speaker 200, being attached to the leading tube joining part 831. Also, the leading tube joining part 831 is joined to the leading tube 820.

Moreover, the rear cover 832 has rear cover air holes 832*a* formed therein. These rear cover air holes 832*a* are provided to release pressure received from the diaphragm 120 to behind the speaker 200 and sounds emitted from the diaphragm 120 to behind the speaker 200, so as not to restrict the movement of the diaphragm 120 of the speaker 200 (see FIGS. 1, 2, and 4).

The housing 110 (see FIGS. 1, 2, and 4) of the speaker 200 has, attached thereto, the ear tip joining part 833 which has the sound hole 833*a* formed in the center portion so as not to insulate the sound emitted through the sound hole 131*d* (see FIGS. 1, 2, and 4) of the speaker 200. The ear tip 834 is joined to the ear tip joining part 833. Also, the ear tip 834 has ear tip air holes 834*a* formed therein. The ear tip air holes 834*a* are provided to connect the external acoustic meatus with the outer side thereof. Thus the user is unlikely to feel unpleasant even when wearing the hearing aid for a long time.

Also, the speaker 200 is connected with the electric wire in the leading tube 820.

<Effect>

The effects of the hearing aid 800 are described below.

The receiver of the hearing aid is generally inserted into the acoustic meatus and includes the following two types: closed-type receivers which includes no space between the ear drum side of the external acoustic meatus and the outer side thereof; and open-type receivers which provides the space with an air hole or the like.

In the closed-type receiver, a sound emitted from the receiver does not leak from the external acoustic meatus, and therefore the sound is well reproduced including the bass thereof, thereby providing an excellent sound pressure frequency characteristic as an advantage. The closed-type receiver, however, is likely to cause a user to feel unpleasant due to moisture trapped in the ear after the user wears the receiver for a long time, or the like. Therefore, the open-type receiver, which is relatively unlikely to cause such unpleasantness, is in high demand.

Accordingly, the improvement of the sound pressure frequency characteristic in the open-type receiver is desired.

Figure 19:
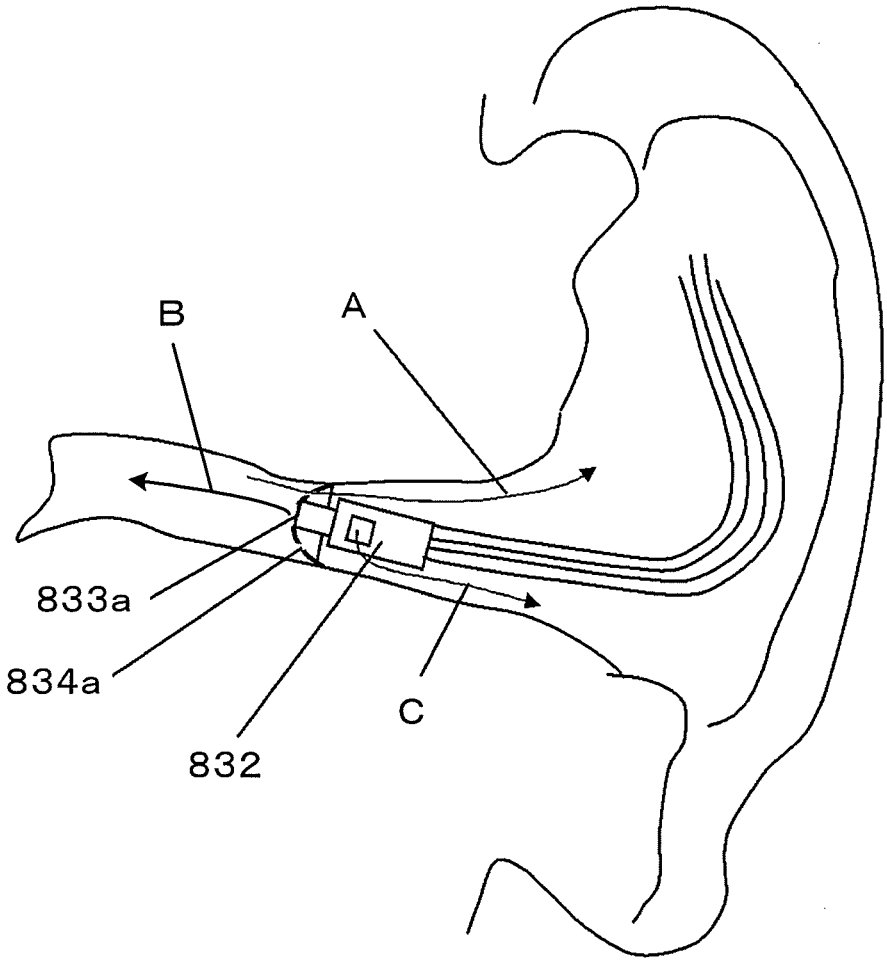
FIG. 19 is a diagram showing a state where an open-type receiver is worn in the ear.

FIG. 19 is a diagram showing a state where the open-type receiver is worn in the ear.

In FIG. 19, the sound emitted from the receiver reaches the ear drum to aid the user in hearing, and, at the same time, some of the sound (indicated by an arrow A in FIG. 19) leaks to the outside through the air hole.

Therefore, in the present embodiment, an open-type ear tip having air holes is used to measure characteristics of a dummy head.

A Brël & Kjaer dummy head (Head and Torso Simulator TYPE 4128) having a microphone in the acoustic meatus is used for the measurement.

Figure 20:
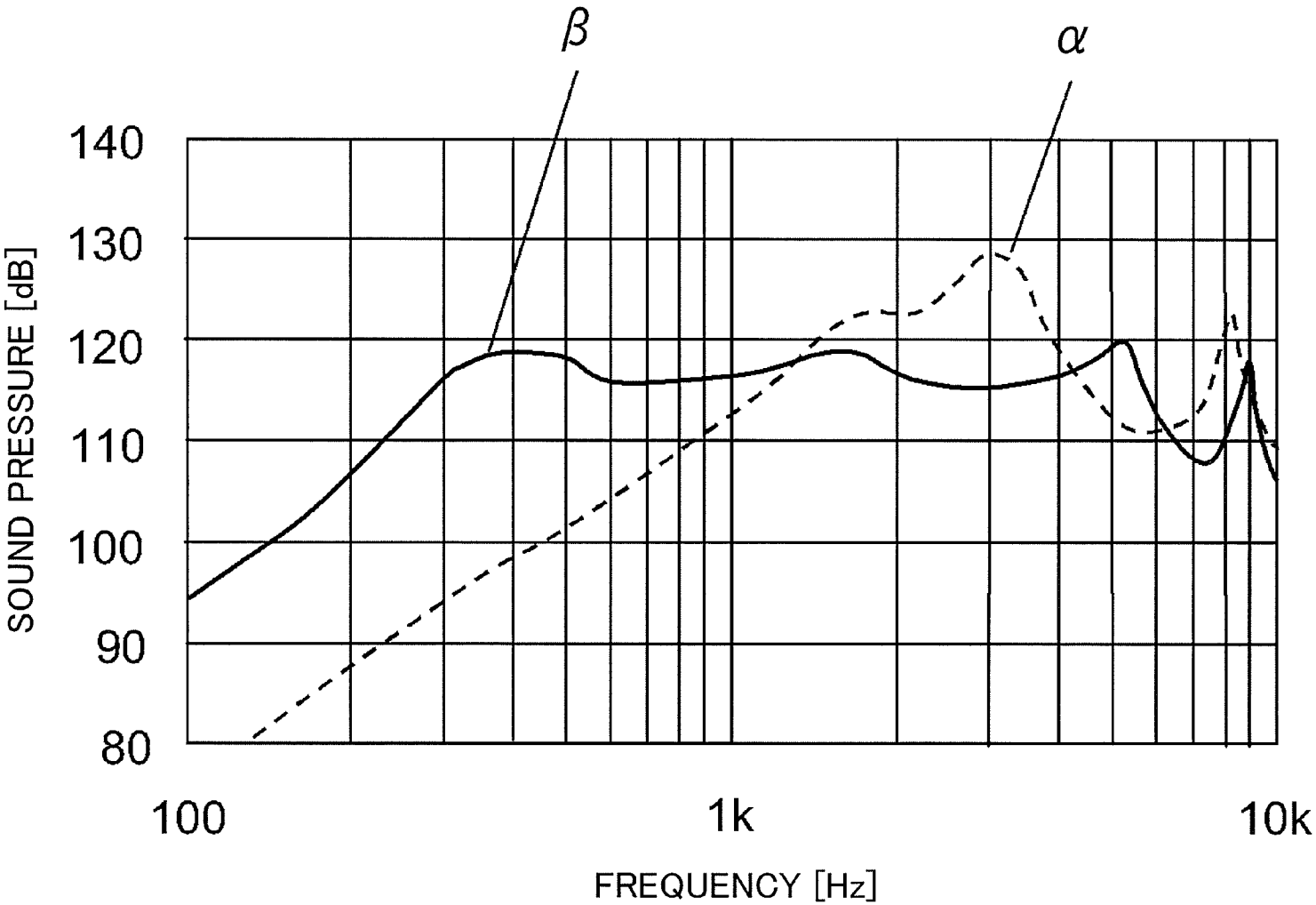
FIG. 20 is a diagram showing a sound pressure frequency characteristic of an open-type hearing aid according to a fourth embodiment.

FIG. 20 is a diagram showing a sound pressure frequency characteristic of an open-type hearing aid according to the present embodiment. In FIG. 20, the horizontal axis indicates the frequencies, and the vertical axis indicates the sound pressure levels. The dotted line α in FIG. 20 indicates the sound pressure frequency characteristic of the conventional hearing aid using an electromagnetic receiver, which is most widely used for hearing aids. This electromagnetic receiver used in the conventional hearing aid has a substantially rectangular prism having a width of 5.4 mm, a length of 7 mm, and a thickness of 3.5 mm. The lowest resonance frequency is about 3 kHz. The solid line β in FIG. 20 indicates the sound pressure frequency characteristic of the hearing aid 800. The speaker 200 used in the hearing aid 800 has a substantially rectangular prism, the main surface having 5.4 mm square and a thickness of 3.5 mm. The diaphragm 120 is formed of PEI (polyetherimide) film having a material thickness of 10 μm. The diaphragm 120 and the movable supports 140*a* through 140*d* (see FIGS. 1 and 2) are integrally formed by using the same material. Here, the viscosity of the magnetic fluid 134 (see FIG. 4) is 100 mPas. According to such configurations, the speaker 200 allows the lowest resonance frequency to be reduced to about 300 Hz, and thus the bass reproduction bandwidth is greatly broadened as compared to that of the conventional electromagnetic receiver. Because of this, as shown in FIG. 20, the hearing aid 800 has the sound pressure level about 20 dB higher than the conventional hearing aid at the frequency range around, for example, between 150 Hz to 450 Hz, which indicates that the sound quality of the reproduction sound is greatly improved.

In the present embodiment, the sound (indicated by an arrow B in FIG. 19) is emitted toward the ear drum (not shown), passing from the rear surface side (a surface on which the voice coil 133 is mounted) of the diaphragm 120 on which the voice coil 133 (see FIG. 4) is mounted, through the sound hole 131*d* (see FIG. 4) provided at the center portion of the magnetic circuit 131 (see FIG. 4).

On the other hand, the sound (indicated by an arrow C in FIG. 19), which leaks from the front surface side (a surface on which the voice coil 133 is not mounted) of the diaphragm 120, is emitted from the rear cover air holes 832*a* (see FIG. 18) formed in the rear cover 832. The sound emitted to the front surface side of the diaphragm 120 and the sound emitted to the rear surface of the diaphragm 120 are in antiphase. Thus, some of the sound (indicated by the arrow C in FIG. 19) leaking from the front surface side of the diaphragm 120 enters through the ear tip air hole 834*a* (see FIG. 18), which is likely to reduce the sound pressure which reaches the ear drum. In the conventional hearing aid, in order to prevent the influence caused by this antiphase sound leaking from the front surface side of the diaphragm, the front surface side of the diaphragm is nearly perfectly closed. Closing the front surface side of the diaphragm increases the acoustic stiffness in the cabinet, thereby increasing the lowest resonance frequency in the diaphragm in general. However, since the conventional hearing aid has high lowest resonance frequency of the diaphragm, which is 3 kHz, even if the front surface side of the diaphragm is nearly perfectly closed, the lowest resonance frequency of the diaphragm barely increases, and thus no problem occurs. On the other hand, in the present embodiment, the lowest resonance frequency is as low as 300 Hz, and therefore, if the front surface side of the diaphragm is closed, a problem occurs that the lowest resonance frequency of the diaphragm increases. However, the acoustic impedance of the external acoustic meatus from the ear tip air hole 834*a* to the ear drum is greater than the acoustic impedance viewed in a direction from the ear tip air hole 834*a* to the outside. As a result, the sound that reaches the ear drum from the rear surface side of the diaphragm can be almost unaffected by the antiphase sound leaking from the front surface side of the diaphragm.

Further, the speaker of any of the embodiments or variations described above is applicable to the present embodiment.

<Summary>

As described above, when the speaker that has the movable supports provided therein in the four corner regions of the diaphragm to reduce the stiffness of the movable supports is used in the hearing aid, the lowest resonance frequency is reduced, and the bass reproduction bandwidth is improved, thereby providing a state where the sound remains unaffected by the antiphase sound.

[Fifth Embodiment]

<Overview>

In a fifth embodiment, a description is given of an example where the speaker according to any of the embodiments described above is mounted in a mobile information processing device and its effects.

<Configuration>

Figure 21:
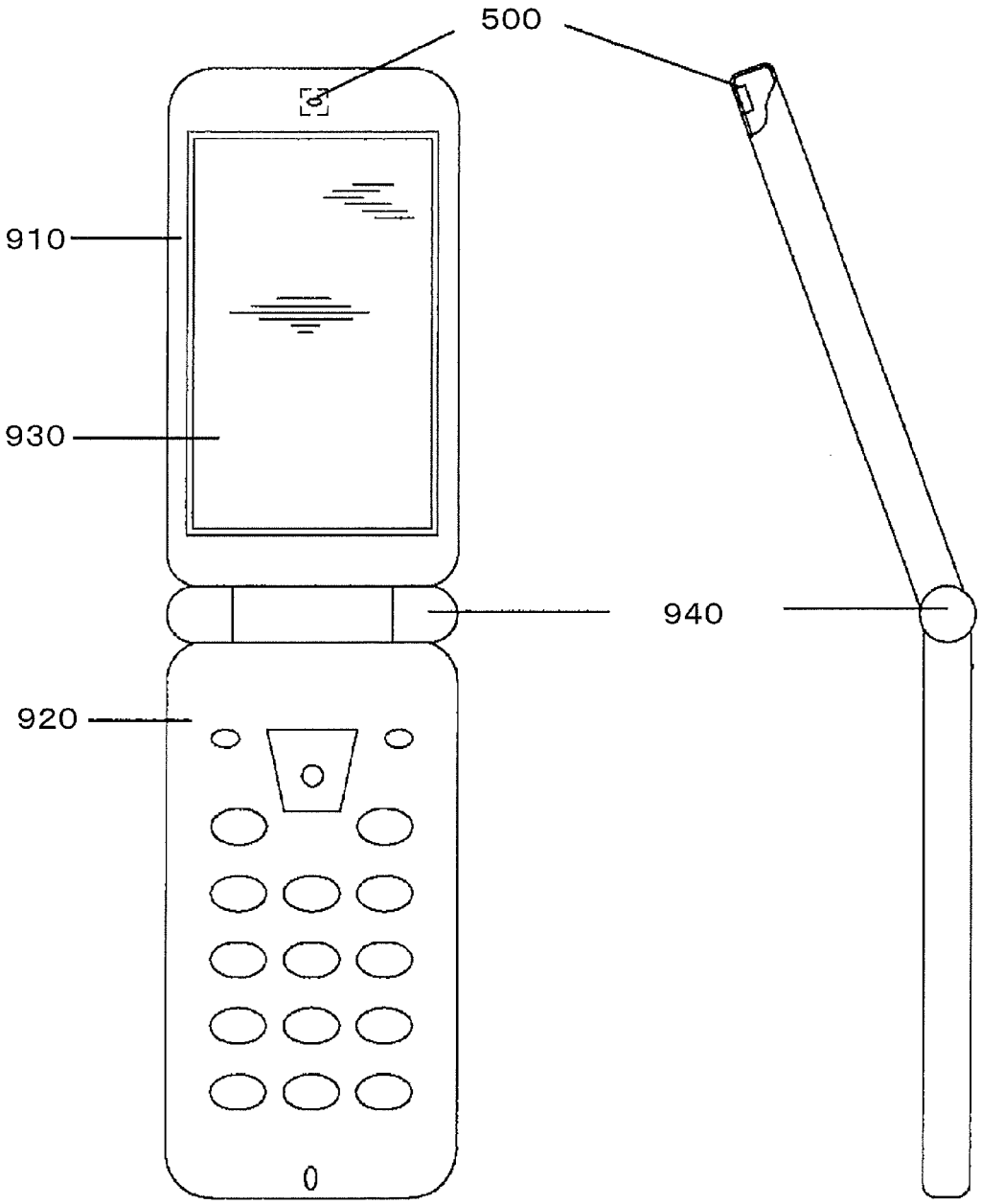
FIG. 21 is a diagram showing usage of the speaker according to any of the embodiments described herein, which is mounted in a mobile phone that is an example of a mobile information processing device.

FIG. 21 is a diagram showing usage of the speaker according to any of the embodiments described above, which is mounted in a mobile phone that is an example of the mobile information processing device.

A mobile phone 900 shown in FIG. 21 is a mobile phone which has mounted therein the speaker 500, in which the first variation is applied to the second embodiment. The mobile phone 900 includes the speaker 500, an upper housing 910, a lower housing 920, a liquid crystal screen 930, and a hinge part 940.

Here, the mobile phone 900 is a foldable mobile phone including the upper housing 910 and the lower housing 920. The upper housing 910 is coupled with the lower housing 920 so as to be pivotable about the hinge part 940. Moreover, the upper housing 910 is provided with the liquid crystal screen 930, and the speaker 500, which is a receiver for reproducing the received voice, is disposed above the liquid crystal screen 930.

<Effect>

The effects of the mobile phone 900 are described below. In the evaluation of a general speaker, a measurement is conducted at a position spaced from a microphone by a predetermined distance. On the other hand, in the evaluation of the receiver for reproducing the received voice in the mobile phone, the receiver is mounted on a dedicated acoustic coupler for the measurement.

In general, when a mobile phone is used, a user holds the housing of the mobile phone against the ear to hear the received voice, and thus it is difficult to eliminate a space between the housing of the mobile phone and the ear by using the housing of the mobile phone only. Additionally, since the recent liquid crystal screens of the mobile phones have become larger over time, the receiver is mounted near the front perimeter of the upper portion of the housing, and therefore it is even more difficult to eliminate the space between the housing of the mobile phone and the ear. Consequently, it is necessary to assume a state where the received voice leaks, and thus Type 3.2 hi-leak acoustic coupler defined by International telecommunication union (ITU) standard is used as an acoustic coupler, and the effects of the mobile phone 900 are verified.

Figure 22:
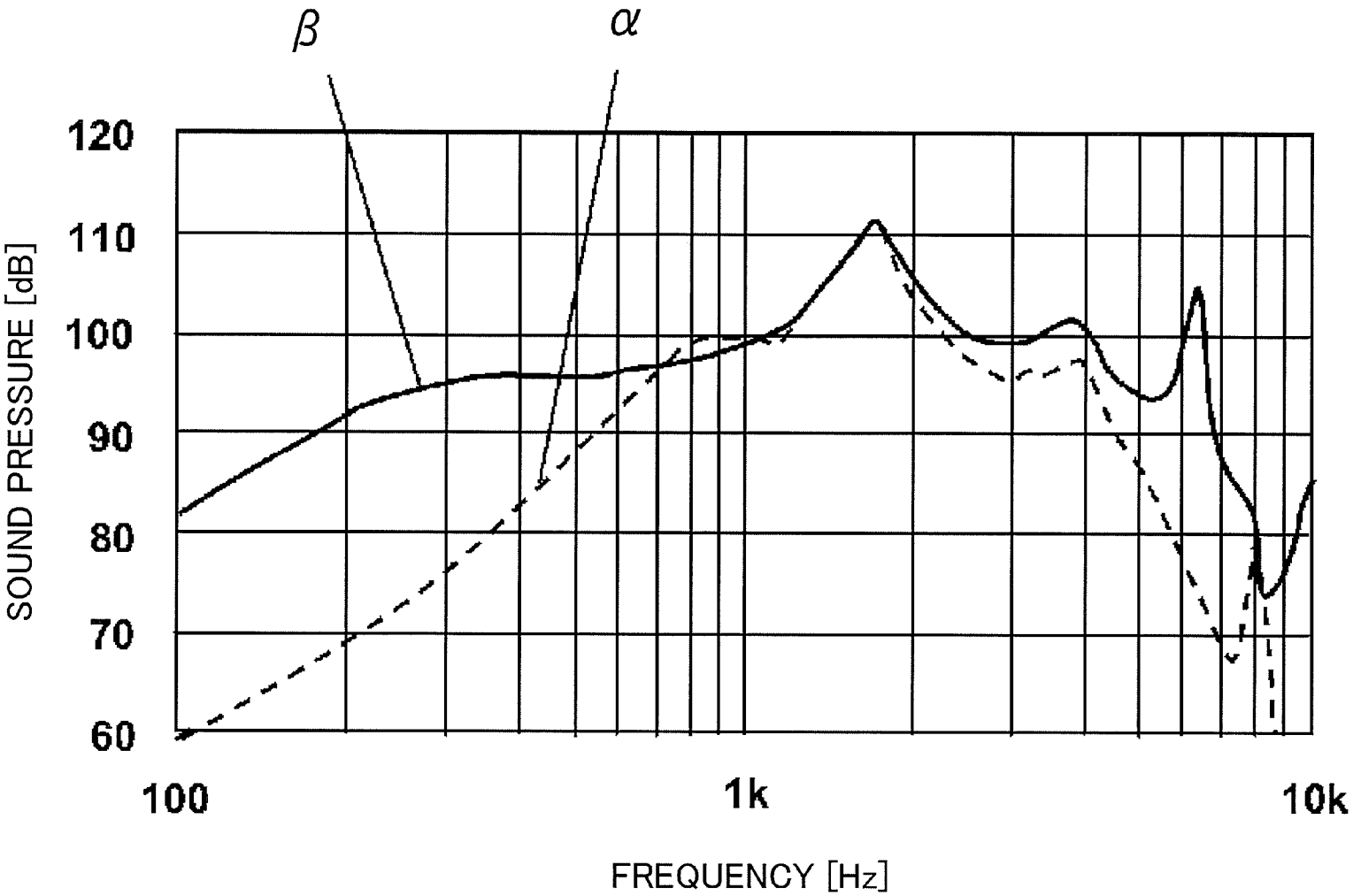
FIG. 22 is a diagram showing a sound pressure frequency characteristic of the mobile phone according to a fifth embodiment.
Figure 23A:
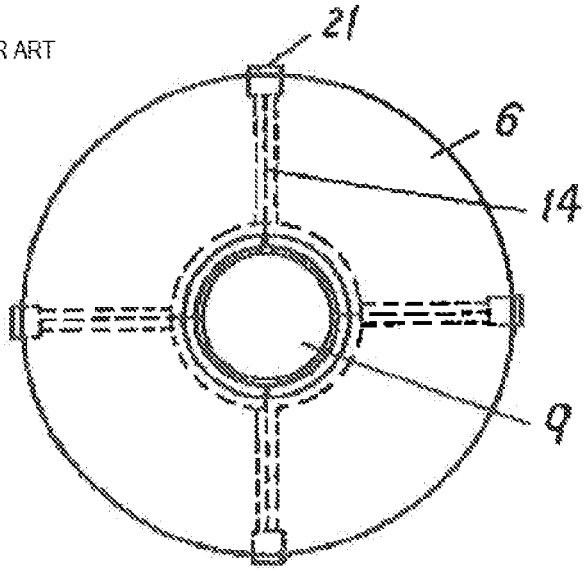
FIG. 23A PRIOR ART
FIG. 23A is a front view of a conventional speaker disclosed in Patent Literature 1.
Figure 23B:
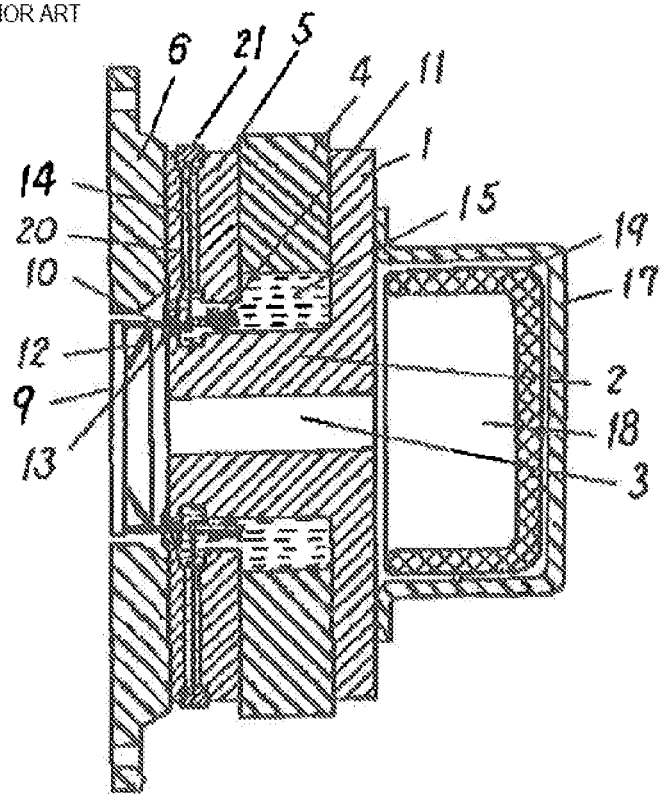
FIG. 23B PRIOR ART
FIG. 23B is a sectional view of the conventional speaker.

FIG. 22 is a diagram showing the sound pressure frequency characteristic of the mobile phone according to the present embodiment. In FIG. 22, the horizontal axis indicates the frequencies, and the vertical axis indicates the sound pressure levels. A dotted line α in FIG. 22 indicates the sound pressure frequency characteristic of a conventional mobile phone using a conventional electrodynamic receiver. Unlike the speaker 500 of the present invention, this conventional electrodynamic receiver used in the mobile phone is provided with a movable support which is not divided in a plurality of parts. The electrodynamic receiver has a substantially rectangular prism having a width of 5 mm, a length of 10 mm, and a thickness of 2.5 mm, in which the entire outer circumference of the diaphragm is supported by the movable support. Since the support is not divided, the stiffness of the support is high and the lowest resonance frequency is about 950 Hz. A solid line β in FIG. 22 indicates the sound pressure frequency characteristic of the mobile phone 900. The speaker 500 used in the mobile phone 900 has a substantially rectangular prism having a width of 5 mm, a length of 10 mm, and a thickness of 2.5 mm. The diaphragm 420 having a track shape perimeter (see FIGS. 9 and 12) is formed of PEN (polyethylene naphthalate) film having a material thickness of 16 μm. The viscosity of the magnetic fluid 501 is 100 mPas. Since the speaker 500 has the support which is divided according to such configurations, the stiffness of the supports can be reduced, and the lowest resonance frequency can be reduced to about 250 Hz, thereby greatly broadening the bass reproduction bandwidth as compared to the conventional electromagnetic receiver. Thus, as shown in FIG. 22, the mobile phone 900 has the sound pressure level about 20 dB higher than the conventional mobile phone, at the frequency range, for example, around between 100 Hz to 300 Hz, which indicates that the sound quality of the reproduction sound is improved greatly.

<Summary>

As described above, when the speaker, which has the movable supports provided therein in the four corner regions of the diaphragm to reduce the stiffness of the movable supports, is used for the mobile phone, the lowest resonance frequency is reduced, thereby improving the bass reproduction bandwidth.

Note that, any of the embodiments and variations described above can be implemented in appropriate combination with each other unless otherwise contradicted by context.

Industrial Applicability

A speaker of the present invention, although small scale, allows wideband reproduction, and thus, if mounted in a mobile electronic device, the device can easily be reduced in size entirely. Particularly the achievement of both the size reduction of the speaker and the high quality sound reproduction with broadened limitation of the bass reproduction is possible, the speaker is useful for hearing aids or mobile electronic devices, such as mobile phones, which require high quality sound, and its value in terms of industrial usefulness is extremely high.

DESCRIPTION OF THE REFERENCE CHARACTERS

100 speaker
110 housing
111 first main surface
112 first opening portion
113 second main surface
114 second opening portion
115*a*, 115*b*, 115*c*, 115*d* corner region
120 diaphragm
130 driving unit
131 magnetic circuit
131*a* yoke
131*b* magnet

131*c* plate
131*d* sound hole
132 magnetic gap
133 voice coil
134 magnetic fluid
140*a*, 140*b*, 140*c*, 140*d* movable support
141*a*, 141*b*, 141*c*, 141*d* elastic body
142*a*, 142*b*, 142*c*, 142*d* coupling
143*a*, 143*b*, 143*c*, 143*d* rib
144*a*, 144*b*, 144*c*, 144*d* spacer
200 speaker
300 speaker
400 speaker
410 housing
411 first main surface
415*a*, 415*b*, 415*c*, 415*d* corner region
420 diaphragm
420*a* rib
430 driving unit
431 magnetic circuit
431*a* yoke
431*b* magnet
431*c* plate
431*d* sound hole
432 magnetic gap
433 voice coil
440*a*, 440*b*, 440*c*, 440*d* movable support
441*a*, 441*b*, 441*c*, 441*d* elastic body
442*a*, 442*b*, 442*c*, 442*d* coupling
443*a*, 443*b*, 443*c*, 443*d* spacer
500 speaker
501 magnetic fluid
541*a*, 541*b*, 541*c*, 541*d* elastic body
600 speaker
700 speaker
740*a*, 740*b*, 740*c*, 740*d* movable support
741*a*, 741*b*, 741*c*, 741*d* elastic body
742*a*, 742*b*, 742*c*, 742*d* spacer
800 hearing aid
810 hearing aid body
820 leading tube
830 receiver
831 leading tube joining part
832 rear cover
832*a* rear cover air hole
833 ear tip joining part
833*a* sound hole
834 ear tip
834*a* ear tip air hole
900 mobile phone
910 upper housing
920 lower housing
930 liquid crystal screen
940 hinge part

The invention claimed is:

1. A speaker, comprising:

a housing having a box-like shape, and having a rectangular main surface having an opening;

a diaphragm having almost a round, elliptical, or track shape and disposed so as to cover the main surface;

a plurality of movable supports disposed in a region, of the main surface, which is not covered with the diaphragm, the plurality of movable supports configured to support an outer circumference of the diaphragm by joining the housing and the diaphragm such that the diaphragm is vibratable;

a magnetic circuit, disposed in the housing, configured to have a magnetic gap;

a voice coil having one portion inserted into the magnetic gap, and the other portion joined to the diaphragm; and a magnetic fluid filled in a gap between the voice coil and the magnetic circuit, the magnetic fluid preventing sound emitted from a rear surface of the diaphragm from leaking through the magnetic gap to the outside of the speaker, wherein there is no overlap between each of the movable supports and the diaphragm, the outer circumference of the diaphragm does not contact with any member in a region other than a portion, of the diaphragm, which is supported by the plurality of movable supports, and the plurality of movable supports each includes:

an elastic body disposed parallel to a corresponding one of sides of the rectangular main surface, and having an almost arc-shaped cross section, and a coupling, disposed on the same plane as a plane where the diaphragm is disposed, configured to have an almost straight-line-shaped cross section, to couple between the elastic body and the diaphragm, and to vibrate together with the diaphragm.

2. The speaker according to claim 1, wherein each of the movable supports includes a rib that is disposed in the coupling which vibrates together with the diaphragm and that enhances rigidity.

3. The speaker according to claim 1, wherein each of the movable supports is located in a region which is substantially surrounded by the outer circumference of the diaphragm and a portion, of two sides of the main surface, near a vertex formed by the two sides.

4. The speaker according to claim 1, wherein the plurality of movable supports are integrally formed with the diaphragm, and a thickness of the elastic body is less than that of the diaphragm.

5. The speaker according to claim 1, wherein the magnetic circuit includes at least one sound hole extending therethrough in a direction perpendicular to the main surface.

* * * * *